United States Patent [19]

Evans

[11] Patent Number: 5,031,579

[45] Date of Patent: Jul. 16, 1991

[54] COOLING SYSTEM FOR INTERNAL COMBUSTION ENGINES

[76] Inventor: John W. Evans, 253 Gay St., Sharon, Conn. 06069

[21] Appl. No.: 465,801

[22] Filed: Jan. 12, 1990

[51] Int. Cl.[5] ..... F01P 9/02

[52] U.S. Cl. ..... 123/41.2; 123/41.42; 123/41.54; 123/41.74

[58] Field of Search ..... 123/41.01, 41.1, 41.2, 123/41.21, 41.25, 41.27, 41.28, 41.42, 41.54, 41.72, 41.74

[56] References Cited

U.S. PATENT DOCUMENTS

| | | | |
|---|---|---|---|
| 1,338,722 | 5/1920 | Fekete | 123/41.18 |
| 1,432,518 | 10/1922 | Muir | 123/41.25 |
| 1,630,070 | 5/1927 | Muir | 123/41.25 |
| 1,658,934 | 2/1928 | Muir | 123/41.25 |
| 1,789,540 | 1/1931 | Brubaker | 123/41.72 |
| 1,806,382 | 5/1931 | Barlow | 123/41.54 |
| 2,353,966 | 7/1944 | Newcombe | 123/174 |
| 2,403,218 | 7/1946 | Hanners | 123/174 |
| 3,082,753 | 3/1963 | Bullard | 123/41.08 |
| 3,102,156 | 9/1963 | Gist et al. | 123/8 |
| 3,384,304 | 5/1968 | Barlow | 237/8 |
| 3,390,667 | 7/1968 | Beurtheret | 123/8 |
| 3,731,660 | 5/1973 | Leffert | 123/41.42 |
| 3,939,901 | 2/1976 | Cieszko et al. | 165/1 |
| 4,367,699 | 1/1983 | Evans | 123/41.23 |
| 4,389,371 | 6/1983 | Wilson et al. | 422/15 |
| 4,404,113 | 9/1983 | Peters et al. | 252/75 |
| 4,545,335 | 10/1985 | Hayashi | 123/41.27 |
| 4,550,694 | 11/1985 | Evans | 123/41.02 |
| 4,563,983 | 1/1986 | Hayashi et al. | 123/41.2 |
| 4,590,893 | 5/1986 | Hirano | 123/41.21 |
| 4,601,265 | 7/1986 | Wells et al. | 123/41.28 |
| 4,630,572 | 12/1986 | Evans | 123/41.21 |
| 4,646,688 | 3/1987 | Hirano et al. | 123/41.27 |
| 4,648,356 | 3/1987 | Hayashi | 123/41.21 |
| 4,648,357 | 3/1987 | Hayashi | 123/41.27 |
| 4,649,869 | 3/1987 | Hayashi | 123/41.21 |
| 4,658,765 | 4/1987 | Hayashi | 123/41.21 |
| 4,658,766 | 4/1987 | Hirano | 123/41.21 |
| 4,677,942 | 7/1987 | Hayashi | 123/41.21 |

FOREIGN PATENT DOCUMENTS

| | | | |
|---|---|---|---|
| 480461 | 2/1938 | United Kingdom . | |
| 491647 | 9/1938 | United Kingdom | 123/41.28 |

OTHER PUBLICATIONS

"Hybrid TM Engine Cooling," Mecca Development, Inc., 1988.

Stefanides, "Magnesium Block Cuts Engine's Weight, Special coolant does not corrode magnesium," Design News, pp. 20–21, Dec. 18, 1989.

(List continued on next page.)

*Primary Examiner*—Noah P. Kamen

*Attorney, Agent, or Firm*—Gottlieb, Rackman & Reisman

[57] ABSTRACT

An apparatus for cooling an internal combustion engine has a coolant jacket surrounding the cylinder walls, the combustion chamber domes, and the exhaust runners of the engine. The coolant jacket has formed therein a coolant chamber. A substantially anhydrous, boilable liquid coolant, having a saturation temperature higher than that of water, is pumped through the coolant chamber to cool the metal surfaces of the engine. A radiator is coupled in fluid communication with the coolant chamber to receive coolant flowing therefrom and to reduce the temperature of the coolant by heat exchange therewith. A pump is coupled in fluid communication with the coolant chamber and the radiator to pump the coolant therethrough. The coolant is distributed and pumped at a flow rate so that the coolant vaporized upon contact with the hotter metal surfaces of the engine substantially condenses within the liquid coolant. A vent line is coupled on one end to the coolant chamber and coupled on the other end to an expansion tank. A U-shaped section of the vent line extends above the highest level of coolant in the system. The expansion tank is provided to receive gases, vapor, and/or expanded coolant from the coolant chamber. The expansion tank always holds some coolant to maintain a liquid coolant barrier between the coolant chamber and the ambient atmosphere.

55 Claims, 7 Drawing Sheets

OTHER PUBLICATIONS

Dunne, "Cool-out," Popular Mechanics, p. 42, Jun. 1987.
Yeaple, "Hotter Coolant Cools Engine Hot Spots," Design News, pp. 100-102, Dec. 7, 1987.
"Host of advantages claimed for hybrid cooling system," Automotive News, Jul. 29, 1985.
Port, "What Hotter Coolant Could Do For Car Engines," Business Week, Dec. 9, 1985.
Weissler, "National Technologies' hybrid cooling approach," Automotive Cooling Journal, vol. 29, No. 1, pp. 32-39, 1986.
"Hybrid cooling system intrigues Callaway," Ward's Engine Update, vol. 13, No. 9, pp. 7-8, May 1, 1987.
Schinhofen, "Chevy Cool," Test & Technik, pp. 36-39, 1987.
"New Method of Engine Cooling," N.A.T.L. News, Nov.-Dec. 1987.
Richards, "A waterless cooling system," Commercial Carrier Journal, p. 68, Sep. 1987.
Evans and Light, "Hybrid engine cooling," Automotive Technologies International, pp. 208-211, 1987.
Sawyer, "Not To Be Overshadowed . . . There's another super Corvette, The Twin-Turbo, and Callaway is turning up the wick on it for 1988," Auto Week, Jul. 20, 1987.
Sessions, "Gone Kingfishin'," Road & Track, p. 51, Feb. 1988.
Deierlein, "Cooling Systems," Fleet Equipment, pp. 29-31, Sep. 1988.
Evans and Light, "Expanding the Limits on Engines and Vehicles Imposed by Circulating Liquid Engine Cooling Systems," S.A.E. Technical Paper Series 861428, 1986.
Alderman, "House Hides High-Tech Auto Firm," Sep. 1, 1988.
Technical Facts & Changes, "New Method of Engine Cooling," Nov./Dec. 1987, p. 29.
"Waterless engine coolant system cuts radiator size in half," Designfax, Aug. 1987, p. 8.
Reed, "Cool It," AutoWeek, Mar. 30, 1987, pp. 36-37.
Berg, "Engine Heat: Cooling It Without Water," Heavy Duty Trucking, Jun. 1987, p. 129.
"Waterless Coolant eyed for Corvette," Ward's Auto World, Jun. 1987, p. 87.
"Bell, Meca's Camaro Subjects of TV Special," The Lakeville Journal, Aug. 13, 1987.
"Sharon Team Seeks Record," The Lakeville Journal, Jul. 10, 1986.
"Race Car from Sharon Setting Records," The Lakeville Journal, May 22, 1986.
Brown, "Cooler heads for hotter engines," Popular Science, Jun. 1986, pp. 80-83, 118.
"Evans Cooling System," Road & Track, Feb. 1986, pp. 70-71.
"New car cooling system could save fuel, mishaps," Poughkeepsie Journal, Nov. 10, 1985.
Sperry, "Dramatic Change in Sharon For Auto Engine Design," Litchfield County Times, Aug. 23, 1985.
Kekacs, "Automotive inventor one of many tinkerers," The Sunday Republican (no date).
Kekacs, "Automotive Inventor . . . ", 1985.
"Technology for cooler heads," Popular Mechanics, Dec. 1984, p. 116.
Wood, "Liquid-Cooled Aero Engines," S.A.E. Journal, vol. 39, Jul. 1936, pp. 267-287.
Gibson, "Aero-Engine Efficiencies," Transactions of the Royal Aeronautical Society, pp. 1-36, No. 3, 1920.
Frank, "High-Temperature Liquid-Cooling," S.A.E. Journal, vol. 25, Oct. 1929, pp. 329-343.
Young, "High Temperature Cooling Systems," S.A.E. Quarterly Transactions, vol. 2, No. 4, Oct., 1948.

FIG. 8
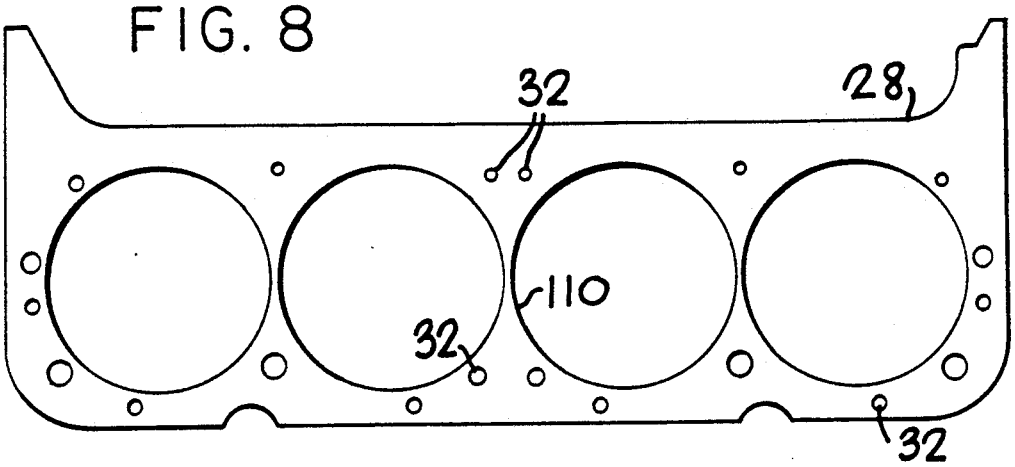
FIG. 6
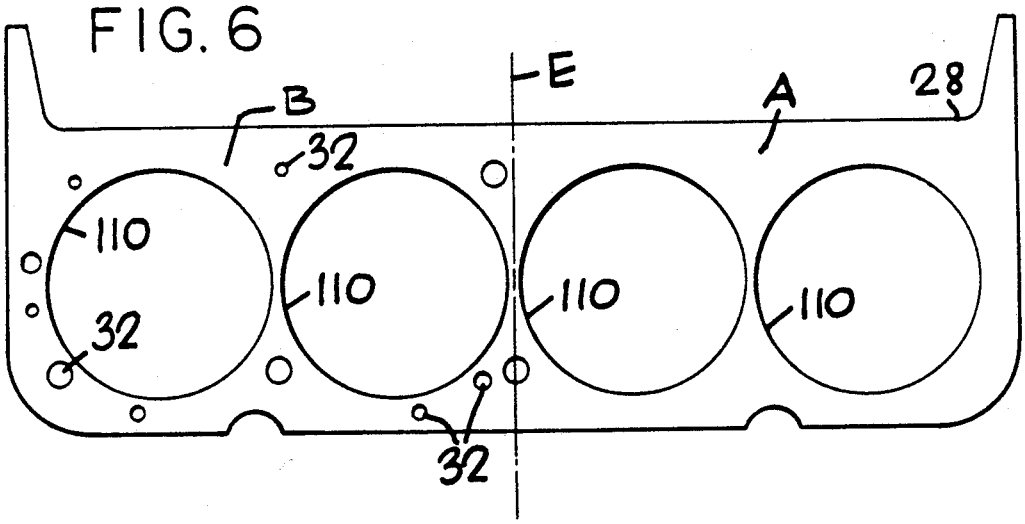
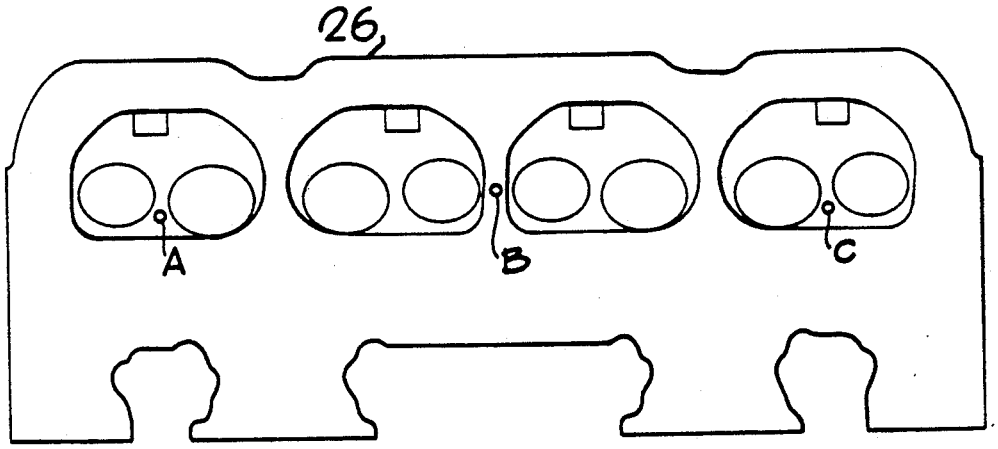
FIG. 9

COOLING SYSTEM FOR INTERNAL COMBUSTION ENGINES

FIELD OF THE INVENTION

The present invention relates to engine cooling systems and, in particular, to cooling systems for internal combustion engines using boilable liquid coolants having saturation temperatures higher than that of water.

BACKGROUND INFORMATION

Conventional engine liquid cooling systems generally use water-based coolants. A commonly used water-based coolant is about 50% water and 50% ethylene glycol (by weight) with additives to protect against corrosion. Such coolants are typically referred to as "antifreeze."

A water-based coolant system is pressurized during vehicle operation by the thermal expansion of the coolant and by the water vapor generated upon localized coolant boiling. The engine radiator is typically equipped with a pressure relief valve that limits the system pressure to about one atmosphere above ambient pressure. An overflow reservoir is provided to hold the coolant purged from the radiator when the pressure relief setting of the valve is exceeded. A second valve is provided to permit the coolant to return to the radiator when the pressure within the radiator falls below the ambient pressure.

Although the water-based ethylene glycol coolants exhibit low freezing points in comparison to water, their boiling and condensation characteristics are similar to that of water. The saturation temperature of water, which is its boiling point and maximum condensation temperature, is about 100° C. at 0 psig and 115° C. at 15 psig; whereas the boiling point of a 50/50 water/ethylene glycol coolant is about 107° C. at 0 psig and 124° C. at 15 psig. Water, however, exhibits a substantial vapor pressure in comparison to ethylene glycol. Therefore, when a 50/50 water/ethylene glycol mixture is boiled, the vapor generated is about 98% water (by volume). At one atmosphere pressure (gauge), the water vapor does not condense above 121° C.

Under heavy load and/or high ambient temperature conditions, the coolant temperature frequently approaches the saturation temperature of water. As a result, the water vapor cannot condense quickly enough to prevent it from occupying and insulating critical areas within the cylinder head. Hot spots develop where the liquid coolant is displaced by vapor from the hot metal surfaces of the engine. Hot spots can cause detonation and excessive NOX emissions.

One approach to preventing detonation is to remove the spark advance. Another approach, used particularly with engines having electronically controlled fuel injection, is to enrich the air to fuel mixture. With turbocharged engines, the turbo air pressure, or boost, can be reduced when the coolant temperatures approach the saturation temperature of water. The problem with these approaches is that each causes a loss of engine performance and/or a decrease in fuel economy.

The ability to control hot spots and detonation is directly related to the ability to condense vapor in the cylinder head. In liquid cooling systems, the temperature of the coolant in low pressure regions, such as upstream of the coolant pump, must be maintained sufficiently below the boiling point of the coolant to prevent flash vaporization. Flash vaporization of the coolant immediately upstream of the pump can cause pump cavitation and, as a result, a sharp decrease in coolant flow. Cavitation is most likely to occur at high pump speeds and/or under high pump suction forces, when the pump input pressure is lowest. Once the coolant flow is interrupted, the coolant can quickly increase in temperature and lead to a total failure of the cooling system.

Conventional cooling systems try to prevent cavitation by drawing lower temperature coolant from the radiator rather than the higher temperature coolant from the engine coolant jacket. The coolant flows from the outlet of the pump, into the engine block, and up through the cylinder head. The coolant entering the cylinder head is therefore preheated by circulation through the lower part of the engine. One problem, however, in pumping the coolant in this direction is that the higher temperature coolant entering the cylinder head is less likely to control the formation of hot spots and detonation.

For water-based coolants, the failure point of the system is the saturation temperature of water, regardless of the concentration of other constituents, such as ethylene glycol. For example, a coolant mixture which is 90% ethylene glycol and 10% water (by weight) will still yield vapor that is about 90% water (by volume) when boiled.

Therefore, with water-based coolants, it is critical that the bulk coolant temperature in the cylinder head not exceed the saturation temperature of water under all operating conditions. The bulk coolant temperature must be maintained below that level if the bulk coolant is to condense the water vapor generated upon contact by the coolant with the hotter metal surfaces of the engine. When that temperature limit is exceeded, none of the water vapor generated can condense. As a result, a large volume of vapor is generated that forces substantial amounts of coolant into the overflow reservoir. The engine must then be stopped immediately to prevent severe damage from the coolant loss.

Certain problems arise, however, in maintaining the temperature of water-based coolants below the saturation temperature of water. Because the lower temperature coolant is pumped into the engine block, and then up through the cylinder head, the cylinder walls are frequently maintained at relatively low temperatures. The low temperature cylinder walls can prematurely quench the combustion flame. As a result, a boundary layer of unburned fuel can develop on the inner surfaces of the cylinder walls. Although the unburned fuel might oxidize before it is exhausted, it is not converted into usable mechanical energy.

Another problem with water-based coolant systems is that vehicle designs employing down-sized radiators, or that reduce the air flow through the radiator, are difficult to implement. Water-based coolant systems usually only maintain a slight difference between the bulk coolant temperature and the saturation temperature of water under heavy operating loads and/or high ambient temperatures. Therefore, the radiators in water-based coolant systems are required to maintain a relatively high rate of heat exchange with the coolant. The required heat exchange rates frequently cannot be maintained with a down-sized radiator, or if the flow rate of air through the radiator is reduced.

Another drawback of water-based coolant systems is that there are substantial benefits in maintaining controlled coolant temperatures well above 100° C.—an operating regime not ordinarily achievable with water-based coolants. By operating with higher temperatures in the cylinder bores, there is less heat rejected from the engine and thus greater engine efficiency. Carbon monoxide (CO) and hydrocarbon (HC) emissions are reduced because there is a more complete burning of the fuel. Conventional water-based coolant systems can only attempt to operate at such high temperatures by increasing the pressure of the system. A high pressure coolant system can be very dangerous, however, particularly because many common coolant constituents, such as ethylene glycol, are toxic and flammable. Moreover, the high pressure conditions typically decrease the life of a coolant system's components, such as hoses, clamps, the pump, and the radiator.

There have been attempts to develop engine cooling systems that do not use water-based coolants. However, each of the known attempts have certain drawbacks or disadvantages that have prevented them from attaining widespread acceptance.

U.S. Pat. No. 4,550,694, dated Nov. 5, 1985, to the same inventor as the present application, shows an apparatus for cooling an internal combustion engine using a boilable liquid coolant having a saturation temperature above 132° C. The vapor generated rises by convection to the highest region or regions of the head coolant jacket. The vapor is then removed through several outlets and conducted through a conduit to a vapor condenser.

The condenser is located above the head coolant jacket in all orientations of the engine in normal use so that the condensate from the condenser can be returned to the engine by gravity through either a return conduit or the same conduit by which the vapor is conducted into the condenser. The condenser is an elongated vessel mounted under the vehicle's hood lengthwise of the engine compartment, sloping up from front to back.

A vent pipe leads from a region high in the condenser and remote from the vapor inlet. A two-way pressure relief valve in the vent pipe blocks the passage of gases from the condenser through the vent pipe until the pressure increases to a predetermined level. When the valve opens, gases from the top of the condenser flow into a recovery condenser, a small vessel located in a place likely to be cool at all times. By choosing a relatively high setting for the valve, generally on the order of 70 kPa (10 psi), the cooling system is effectively closed except under unusually heavy load conditions or large changes in altitude.

The apparatus of the '694 patent can use substantially anhydrous coolants and, therefore, derive certain benefits over water-based coolant systems therefrom. However, one disadvantage of the apparatus is that it requires a condenser. The condenser is relatively bulky and must be mounted above the engine so that it is located above the highest coolant level. This limited flexibility prevents the use of the apparatus in many types of vehicles. And those vehicles that can use the apparatus are limited to only certain designs that can accommodate the condenser. Moreover, the condenser can add a significant cost to producing the cooling system. Its advantages in performance, therefore, frequently do not outweigh its disadvantages with regard to cost and design flexibility.

It is an object of the present invention, therefore, to overcome the problems of known engine liquid cooling systems.

SUMMARY OF THE INVENTION

The present invention is directed to an apparatus for cooling an internal combustion engine with a substantially anhydrous, boilable liquid coolant having a saturation temperature higher than that of water. The apparatus comprises a coolant chamber surrounding the cylinder walls and combustion chambers of the engine, to receive the coolant for cooling the metal surfaces of the engine. A coolant pump is coupled in fluid communication with the coolant chamber. The coolant pump is adapted to pump the coolant through the coolant chamber at a flow rate so that the liquid coolant substantially condenses the coolant vaporized upon contact with the metal surfaces of the engine.

An apparatus of the present invention further comprises means for distributing coolant through the coolant chamber, so that coolant vaporized upon contact with the metal surfaces of the engine substantially condenses in the liquid coolant. A radiator is coupled in fluid communication with the coolant pump and the coolant chamber. The coolant flowing through the radiator is reduced in temperature by heat exchange therewith.

An apparatus of the present invention further comprises means for exhausting gases or vapor from the coolant chamber, coupled in fluid communication therewith, at a location in the apparatus at about ambient pressure or below that pressure. The means for exhausting preferably includes a conduit to receive the gases or vapor in the coolant chamber and to exhaust the gases or vapor from the engine An expansion tank is coupled in fluid communication with the conduit, and thus the coolant chamber, to receive liquid coolant therein. The expansion tank defines an inlet port and an outlet port. The inlet port extends through a bottom wall thereof and is in fluid communication with the coolant chamber. The outlet port extends through a top wall thereof and is in fluid communication with the ambient atmosphere. The inlet port is located below the coolant level in the expansion tank, and the outlet port is located above the coolant level in the expansion tank. The liquid coolant in the expansion tank thus provides a liquid barrier between the outlet port and the coolant chamber.

An apparatus of the present invention further comprises a dehydrating unit coupled in fluid communication with the outlet port of the expansion tank. The dehydrating unit substantially removes the water vapor flowing therethrough and into the expansion tank. The dehydrating unit includes a desiccant material to substantially remove the water vapor.

An apparatus of the present invention further comprises a head gasket seated between a cylinder head and an engine block of the engine. The means for distributing includes a plurality of coolant apertures extending through the head gasket. Each of the coolant apertures is in fluid communication with the coolant chamber to permit coolant to flow therethrough. The location and size of each coolant aperture is determined so that substantially all of the coolant vaporized upon contact with the metal surfaces of the engine is condensed within the liquid coolant.

In one apparatus of the present invention, a first coolant inlet is in fluid communication with the coolant chamber, the radiator, and the pump. A coolant outlet is in fluid communication with the coolant chamber and the pump. The first coolant inlet and the coolant outlet are both located on the same side of the engine. The coolant apertures extend through a section of the head gasket located adjacent to the side of the engine opposite the side of the first coolant inlet and the coolant outlet. The coolant therefore flows from the first inlet toward the back of the engine, then toward the front of the engine and, in turn, through the coolant outlet. There is thus a substantially evenly distributed flow of coolant throughout the coolant chamber.

In another apparatus of the present invention, the coolant outlet is located at about the mid-point of the coolant chamber. The mid-point is measured between a front wall and a rear wall of the engine. A second coolant inlet is in fluid communication with the coolant chamber, and the radiator and/or the pump. The second coolant inlet is located on the opposite side of the engine of the first coolant inlet. The coolant therefore flows into the coolant chamber through the first and second coolant inlets on both sides of the engine. The coolant then flows downwardly through the coolant apertures and, in turn, through the coolant outlet in about the middle of the engine. There is thus a substantially even distribution of coolant throughout the coolant chamber.

The present invention is also directed to a method of cooling an internal combustion engine comprising the following steps: pumping a boilable liquid coolant, having a saturation temperature higher than that of water, within the engine at a flow rate so that substantially all of the coolant vaporized upon contact with the metal surfaces of the engine is condensed by the liquid coolant. The method preferably further comprises the step of distributing the coolant through the engine so that substantially all of the coolant vaporized upon contact with the metal surfaces of the engine is condensed by the liquid coolant.

In one method of the present invention, the coolant is pumped in the direction of the cylinder head toward the engine block of the engine. In another method of the present invention, the coolant is pumped in the direction of the engine block toward the cylinder head of the engine. Another method of the present invention further comprises the step of exhausting gases or vapors from a location in the engine where the pressure is about ambient or below that pressure.

Under one method of the present invention, the coolant includes at least one substance that is miscible with water, and has a vapor pressure substantially less than that of water at any given temperature. The substance of the coolant is selected from a group including ethylene glycol, propylene glycol, tetrahydrofurfuryl alcohol, and dipropylene glycol.

Under another method of the present invention, the coolant includes at least one substance that is substantially immiscible with water, and has a vapor pressure substantially less than that of water at any given temperature. The substance of the coolant is selected from a group including 2,2,4-trimethyl-1,3-pentanediol monoisobutyrate, dibutyl isopropanolamine, and 2-butyl octanol.

One advantage of the apparatus and method of the present invention, is that there is no need for a condenser mounted above the engine. Rather, the coolant is pumped and distributed through the engine so that the liquid coolant substantially condenses the coolant vaporized upon contact with the metal surfaces of the engine.

Another advantage of the apparatus and method of the present invention, is that there is substantially no water in the coolant. Water is treated as an impurity. If there are trace amounts of water in the coolant, the water vapor generated is exhausted through the means for exhausting, such as the conduit and/or expansion tank. The saturation temperature of the coolant is above that of water. Therefore, the engine can be operated with bulk coolant temperatures above 100° C., without the problem of producing large amounts of water vapor, as with water-based coolant systems. Accordingly, the ability to control hot spots and detonation is substantially improved with the apparatus and method of the present invention.

Another advantage of the apparatus and method of the present invention, is that although the coolant may be maintained at a temperature well above 100° C. during vehicle operation, it is still well below its boiling point. Therefore, the coolant can be pumped in the direction of the cylinder head and down into the engine block, without flash vaporization occurring at the inlet of the pump. Accordingly, the problem of pump cavitation encountered in water-based coolant systems can be avoided. Moreover, the lower temperature coolant can be pumped initially into the cylinder head to cool the combustion chamber domes and exhaust runners (the conduits between the combustion chambers and exhaust ports). Because the lower temperature coolant is pumped directly into the cylinder head, the ability to avoid hot spots and detonation is substantially improved over water-based coolant systems.

Another advantage of the apparatus and method of the present invention, is that because the lower temperature coolant is pumped into the cylinder head, the coolant is preheated before it enters the engine block and flows into contact with the cylinder walls. Therefore, the cylinder walls can be maintained at a higher temperature than with water-based coolant systems. As a result, the engine can be run at higher temperatures and, therefore, attain increased efficiency and power.

Other advantages of the present invention will become apparent in view of the following detailed description and drawings taken in connection therewith.

BRIEF DESCRIPTION OF THE DRAWINGS

FIG. 6 is a top plan view of a head gasket for the engine of FIG. 1.

FIG. 8 is a top plan view of a head gasket for the engine of FIG. 7.

FIG. 9 is a bottom plan view of the left cylinder head of a test engine for determining the coolant flow rate and distribution in accordance with the present invention.

DETAILED DESCRIPTION

Figure 1:
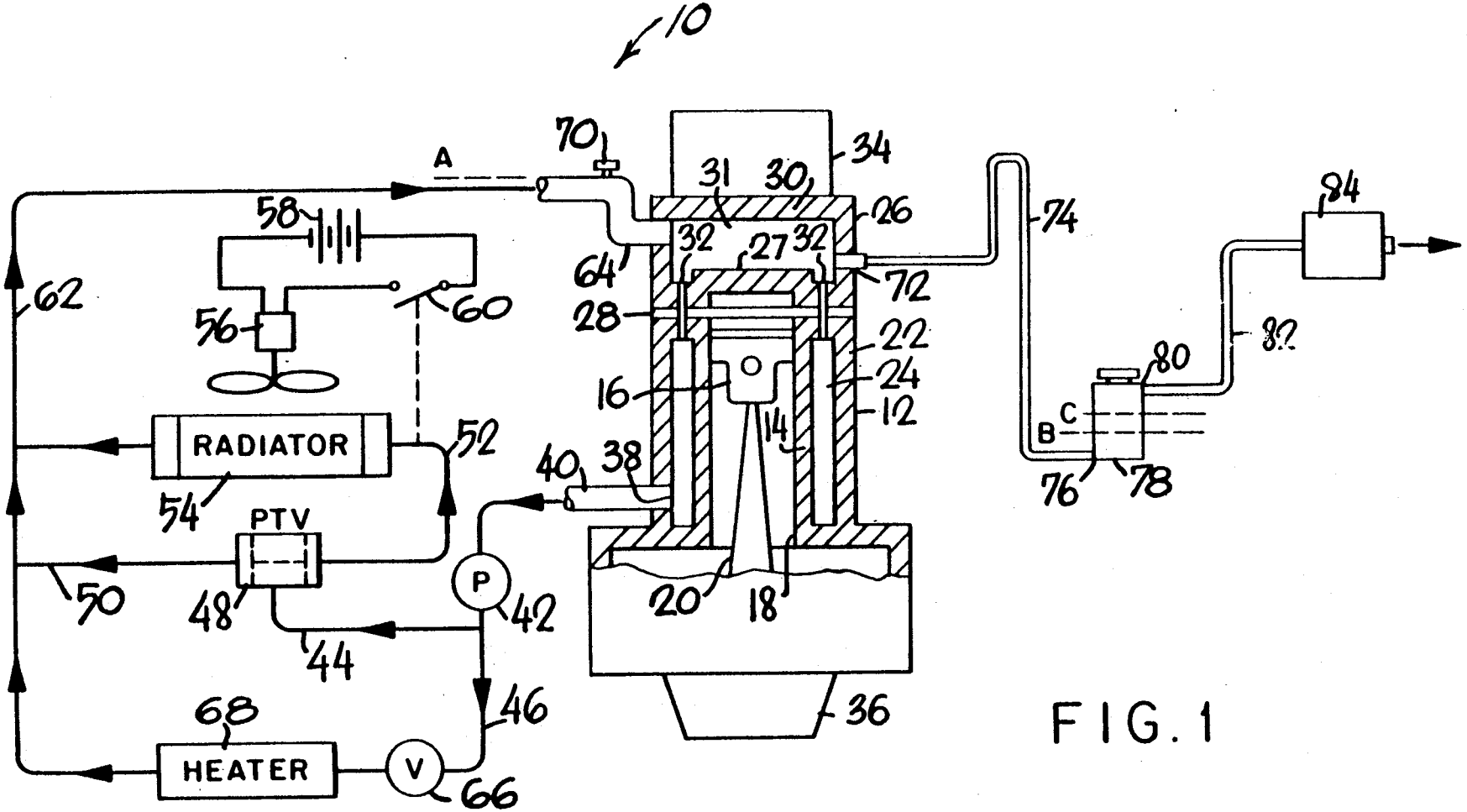
FIG. 1 is a schematic, partial cross-sectional view of an engine embodying the cooling system of the present invention.

In FIG. 1, an internal combustion engine embodying the cooling system of the present invention is indicated generally by the reference numeral 10. The engine 10 is hereinafter described with reference to a motor vehicle (not shown), but can equally be used in other types of vehicles. The engine 10 comprises an engine block 12 which has formed therein several cylinder walls 14. Each cylinder wall 14 defines a cylinder bore 18, and a piston 16 reciprocates within each cylinder bore 18. Each piston 16 is coupled to a connecting rod 20 which is in turn coupled to a crank shaft (not shown).

A block coolant jacket 22 surrounds the cylinder walls 14, and is spaced from the cylinder walls, thus defining a block coolant chamber 24 therebetween. The block coolant chamber 24 is adapted to permit coolant to flow therethrough to cool the metal surfaces of the engine. The preferred coolant used in the system of the present invention is a substantially anhydrous, boilable liquid coolant having a saturation temperature higher than that of water. One such coolant is propylene glycol with additives to inhibit corrosion.

The coolants used in the system of the present invention are organic liquids, some of which are miscible with water and others which are substantially immiscible with water. The coolants that are miscible with water can tolerate a small amount of water. However, the performance of the system of the present invention is enhanced by maintaining the water content at a minimum level, preferably less than 3%. Suitable coolant constituents that are miscible with water include propylene glycol, ethylene glycol, tetrahydrofurfuryl alcohol, and dipropylene glycol. Coolants that are immiscible with water might contain trace amounts of water as an impurity, usually less than one percent (by weight). Suitable coolant constituents that are substantially immiscible with water include 2,2,4-trimethyl-1,3-pentanediol monoisobutyrate, dibutyl isopropanolamine, and 2-butyl octanol. All of the coolant constituents have vapor pressures substantially less than that of water at any given temperature, and have saturation temperatures above about 132° C. at atmospheric pressure.

A cylinder head 26 is mounted to the engine block 12 above the cylinder walls 14. The cylinder head 26 defines a combustion chamber dome 27 above each cylinder bore 18. A combustion chamber is thus defined between each piston 16 and combustion chamber dome 27. A head gasket 28 is seated between the cylinder head 26 and the engine block 12. The cylinder head 26 includes a head coolant jacket 30, which in turn defines a head coolant chamber 31 therein. The head gasket 28 seals the combustion chambers from the coolant chambers and, likewise, seals the coolant chambers from the exterior of the engine.

A plurality of coolant ports 32 extend through the base of the cylinder head 26, through the head gasket 28, and through the top of the block coolant jacket 22. A valve cover 34 is mounted on top of the cylinder head 26. The engine coolant can thus flow either from the head coolant chamber 31, through the coolant ports 32, and into the block coolant chamber 24, or in the opposite direction. The preferred direction, however, is from the head coolant chamber 31 into the block coolant chamber 24, as will be described further below.

The engine 10 further comprises an oil pan 36 mounted to the bottom of the block 12 to hold the engine's oil. An engine oil cooling system (not shown), known to those skilled in the art, can be employed to maintain the engine oil temperature below a certain level. For example, an air-to-oil or liquid-to-oil system can be employed.

A coolant outlet port 38 extends through a bottom wall of the coolant jacket 22, and is in fluid communication with the coolant chamber 24. A first coolant line 40 is coupled on one end to the coolant outlet port 38 and coupled on the other end to the inlet port of a pump 42. The outlet port of the pump 42 is coupled to a second coolant line 44 and a third coolant line 46. The size of the pump 42 is determined to achieve the coolant flow rates required under different operating loads in accordance with the present invention, as will be described further below. As one example, however, for a 350 cubic inch, V-8 engine constructed in accordance with the present invention, the pump 42 achieves a flow rate of about 63 gallons per minute ("GPM") at about a 100° C. coolant temperature, at about 5,200 revolutions per minute ("RPM").

The second coolant line 44 is coupled on the other end to a proportional thermostatic valve (PTV) 48. The PTV 48 is in turn coupled to a bypass line 50 and a radiator line 52. The PTV 48 is set to detect a threshold temperature of the coolant flowing through the second coolant line 44. If the temperature of the coolant is below the threshold, then depending upon the level of the temperature, the PTV 48 directs a proportional amount of coolant through the bypass line 50. If, on the other hand, the coolant temperature is above the threshold, then the PTV 48 directs the coolant into the radiator line 52.

The other end of the radiator line 52 is coupled to a radiator 54. An electric fan 56 is mounted in front of the radiator 54 and is powered by a vehicle battery 58. The fan 56 is controlled by a thermostatic switch 60 which is in turn coupled to the radiator line 52. Depending upon the temperature of the coolant in the radiator line 52, the thermostatic switch 60 operates the fan 56 to increase the airflow through radiator 54, and thus increase the heat exchange with the hot coolant.

Both the output of the radiator 54 and the other end of the bypass line 50 are coupled to an engine input line 62. The input line 62 is in turn coupled to an input port 64 extending through a top wall of the cylinder head 26. Thus, depending upon the temperature of the coolant flowing through the second coolant line 44, the coolant flows either through the bypass line 50 or the radiator 54, which are both in turn coupled to the input line 62. For example, during engine warm-up when the coolant temperature is relatively low, the coolant is directed by the PTV 48 through the bypass line 50. However, once the engine is warmed-up, at least some of the coolant is usually directed through the radiator 54. The lower temperature coolant flowing through the input line 62 flows through the input port 64 and back into the cylinder head coolant chamber 31.

The radiator 54 can be any of a number of radiators available to those skilled in the art. However, the radiator 54 is chosen to accommodate the coolant flow rates determined in accordance with the present invention, as will be described further below. In one embodiment of the present invention, wherein the engine is a 350 inch, V-8, the radiator 54 has a parallel finned tube construction with the following dimensions: 394 mm high; 610 mm wide; 69.9 mm thick; and a substantially constant wall thickness of about 2.8 mm. The radiator is made of aluminium and has 2 rows of tubes with 38 tubes in each row. Each tube has a substantially oval cross-sectional shape and is about 32 mm wide and 518 mm long. The radiator 54 can be made of aluminum, because aluminum is not corroded or eroded by the coolants used in the system of the present invention.

It should be noted that the radiator 54 is not required to retain gases or vapor, as with some known systems and, therefore, does not have to be positioned above the highest level of the coolant. The shape of the radiator can also be unique. For example, it may be curved or made relatively low and with greater horizontal depth in comparison to radiators for water-based coolant systems, to accommodate an aerodynamic-shaped vehicle.

The other end of the third coolant line 46 is coupled to a valve 66. The valve 66 is in turn coupled to the entrance port of a heater 68 to direct the flow of coolant therethrough. The heater 68 is mounted on the vehicle to heat the interior of the vehicle by heat exchange with the hot coolant. The valve 66 is provided to control the flow of coolant to the heater 68. If the valve 66 is closed, then the coolant discharged by the pump 42 flows into the second coolant line 44. Otherwise, depending upon the degree to which the valve 66 is opened, a portion of the coolant flows through the heater 68. The outlet port of the heater 68 is coupled to the engine input line 62. The lower temperature coolant discharged from the heater 68 thus flows through the input line 62, and back into the head coolant chamber 31.

An air bleed valve 70 is mounted to the input line 62 above the input port 64. The air bleed valve 70 is located at or above the highest coolant level in the engine, indicated by the dotted line A in FIG. 1. The air bleed valve 70 is provided to bleed air from the system when filling the system with coolant. Thus, the system of the present invention can be purged of trapped air when it is initially filled with coolant.

A first vent port 72 extends through a bottom portion of the cylinder head 26, and is coupled to a first vent line 74. The first vent line 74 is in turn coupled to an inlet port 76 of an expansion tank 78. The expansion tank 78 is mounted in a convenient location on the vehicle, which can be remote from the engine 10. There is no need for the expansion tank 78 to be located above the highest coolant level A, as is frequently required for expansion tanks or condensers in other coolant systems. However, the first vent line 74 has a U-shaped section which does extend above the highest coolant level A. Thus, any water vapor or noncondensible gases that do rise through the head coolant chamber 31, enter the first vent port 72. The vapor then rises through the U-shaped section of the first vent line 74, and exhausts into the expansion tank 78.

Figure 11:
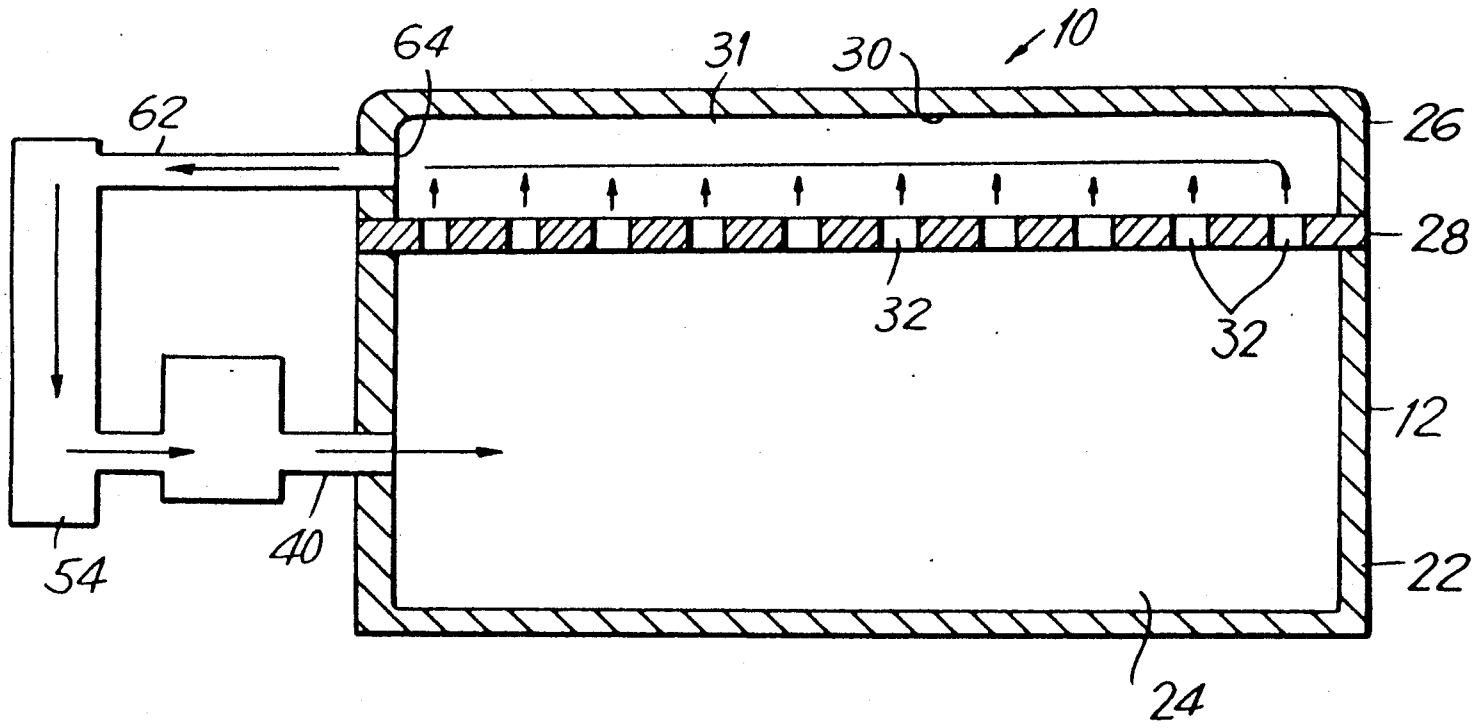
FIG. 11 is a schematic cross-section view of the engine of FIG. 1 with a standard flow alternate configuration.

It should be noted that if the coolant flow is directed from the block coolant chamber 24 into the head coolant chamber 31, then the first vent port 72 is moved to a location where the system pressure is about ambient or below that pressure. The ambient pressure is the atmospheric pressure at a given altitude. For example, the first vent port 72 can be located downstream of the outlet port of the radiator 54. See FIG. 11.

The entrance port 76 is located in a bottom portion of the expansion tank 78. A second vent port 80 extends through a top portion of the expansion tank 78 and is coupled to one end of a second vent line 82. As shown in FIG. 1, the expansion tank 78 has a cold coolant level B, and a hot coolant level C. In either case, the entrance port 76 is located below the coolant level, and the second vent port 80 is located above the coolant level.

After initially filling the system with coolant, the system can remain purged of air by maintaining the minimum level of coolant in the expansion tank 78 above the entrance port 76. A liquid coolant barrier is thus maintained between the entrance port 76 and the head coolant chamber 31. Any air or water vapor within the expansion tank 78 is prevented from passing into the coolant system by the coolant barrier. As a result, the coolant in the engine remains substantially moisture-free.

The first vent line 74 carries primarily expanded coolant during engine warm-up and otherwise infrequent and insubstantial amounts of water vapor. Therefore, the first vent line 74 may have a relatively small diameter, typically about ¼ to 5/16 of an inch. The expansion tank 78 can likewise be relatively small. The expansion tank 78 is only required to handle coolant expanded by temperature variations within the engine, which is normally within the range of about a 4% to 6% increase in volume. In one embodiment of the present invention, the expansion tank 78 has about a one quart capacity for a four gallon cooling system.

Figure 2:
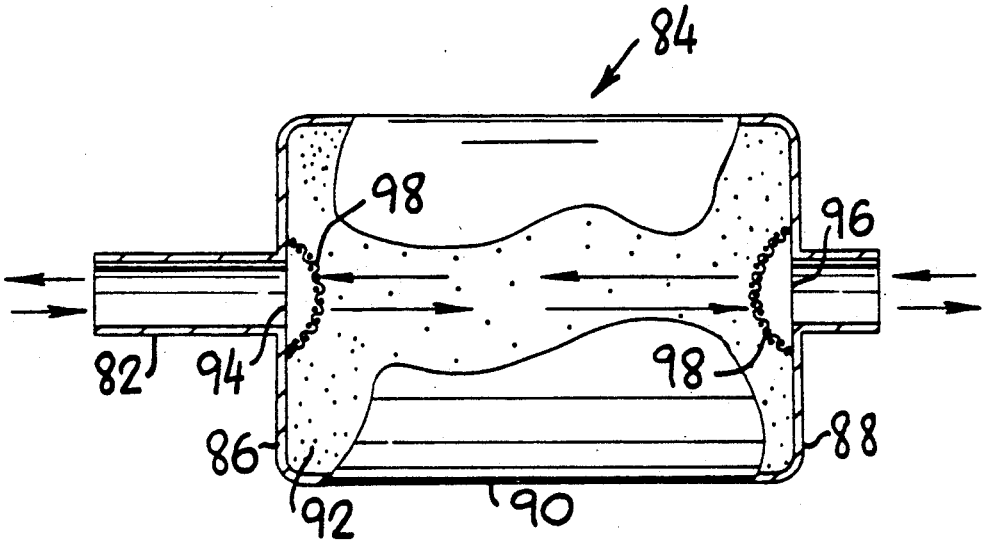
FIG. 2 is a partial cross-sectional view of a dehydrating cannister for the engine of FIG. 1.

The engine 10 further comprises a dehydrating cannister 84, shown in further detail in FIG. 2. The cannister 84 includes a front wall 86, a rear wall 88, and a cylindrical wall 90 extending therebetween. A desiccant material 92 is contained within the cylindrical wall 90. The desiccant material 92 removes the water vapor from air and is commercially available from Dri-Air, Inc., of Chicago, Ill. The cannister 84 further defines an entrance port 94 extending through the front wall 86, and an exit port 96 extending through the rear wall 88. The entrance port 94 is coupled to the other end of the second vent line 82. Two fine mesh screens 98 are each mounted in front of the entrance port 94 and the exit port 96, respectively. The screens 98 are provided to prevent the desiccant material 92 from falling out of the cannister.

The air flowing into and out of the expansion tank 78 thus flows through the dehydrating cannister 84, as indicated by the arrows in FIG. 2. During the engine warm-up and cool-down cycles, the expansion of the coolant causes a given volume of air to pass into and out of the expansion tank 78 and, therefore, through the cannister 84. The desiccant material 92 reacts with the air to substantially retain the water vapor therein. As a result, the air entering the expansion tank 78 is substantially moisture free. Proper maintenance of the desiccant material 92 can ensure that the engine coolant remains substantially moisture free. The cannister 84 and/or the desiccant material 92 is therefore preferably replaced after a certain time frame of engine operation, or after the vehicle is driven a certain number of miles, as can be determined by those skilled in the art.

Figure 3:
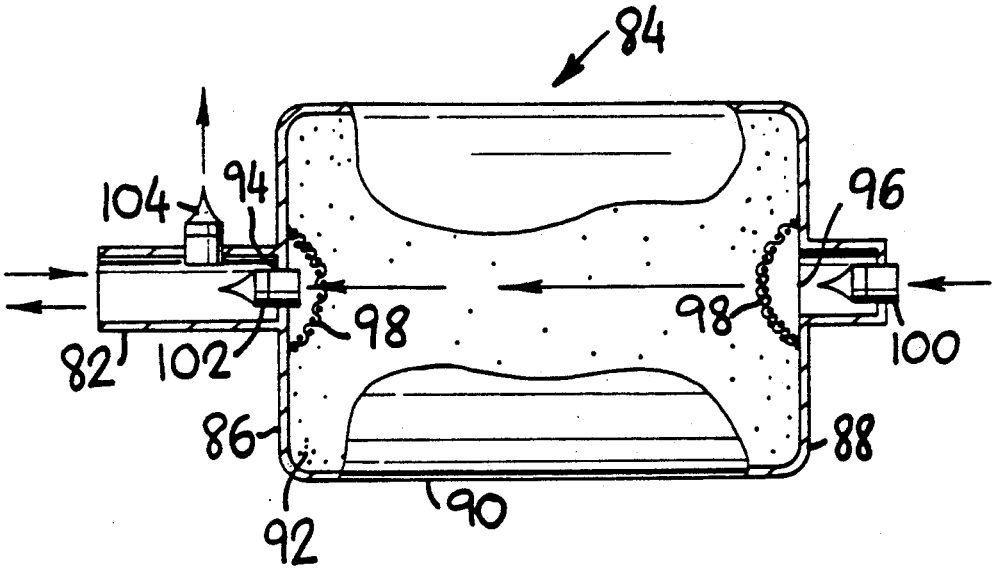
FIG. 3 is a partial cross-sectional view of another embodiment of the dehydrating cannister for the engine of FIG. 1.

In FIG. 3, another dehydrating cannister used with the cooling system of the present invention is illustrated, wherein like reference numerals are used to indicate like elements. The dehydrating cannister 84 further comprises several one-way valves to control the flow of air therethrough. A first valve 100 is mounted in front of the exit port 96. The first valve 100 permits air to flow only through the exit port 96 into the cannister 84, and not in the opposite direction. A second valve 102 is mounted in the entrance port 94. The second valve 102 permits air to flow only from the cannister 84 into the second vent line 82, and not in the opposite direction. A third valve 104 is mounted in the second vent line 82 immediately in front of the entrance port 98. The third valve 104 permits air to flow only from the vent line 82 into the ambient atmosphere, but not in the opposite direction.

The air flowing out of the expansion tank 78 thus does not flow through the cannister 84; whereas the only air flowing into the expansion tank 78 must flow through the cannister 84. Accordingly, only demoisturized air from the cannister 84 flows into the expansion tank 78. One advantage of the cannister 84 of FIG. 3, is that because air flowing out of the expansion tank 78 does not pass through the cannister, the life of the desiccant material 92 will ordinarily be increased.

In the operation of the engine 10, the coolant flows in the direction of the head coolant chamber 31 into the engine block coolant chamber 24. The coolant flow rate through the pump 42 and flow distribution is determined so that when some of the coolant does vaporize upon contact with the hotter metal surfaces of the engine, the vaporized coolant is condensed by the lower temperature coolant before the vapor reaches the first vent port 72, as will be described further below.

Propylene glycol has an atmospheric saturation temperature of about 180° C. and a pour point of about −57° C. Therefore, with propylene glycol, the bulk of the coolant can be maintained at a temperature as high as about 160° C. However, a more preferable operating temperature is about 120° C. The greater the difference between the saturation temperature and the bulk coolant temperature, the greater is the ability of the bulk coolant to condense the vaporized coolant. Although the coolant temperature in the system of the present invention might be substantially higher than that of a system using conventional antifreeze, such as a 50/50 water/ethylene glycol mixture, it is effective because the conditions required for nucleate boiling are maintained during severe or "hot" engine operating conditions.

Nucleate boiling occurs when the coolant is in direct contact with metal surfaces heated to a temperature beyond the boiling point of the coolant. The heat transfer is greatest at the junction between the metal surface and the turbulent or agitated coolant. In the phase change from liquid to vapor, the coolant absorbs a considerable amount of heat. The vapor bubbles generated upon boiling the coolant draw new liquid coolant into contact with the metal surfaces to replace the vaporized coolant. Therefore, under conditions of nucleate boiling, critical engine metal temperatures are limited by the boiling point of the coolant.

"Vapor blanketing" occurs if the liquid coolant is displaced from contact with the metal surfaces of the engine by a vapor layer. Vapor blanketing causes the metal surfaces to become insulated from the coolant, interrupting the heat transfer and, therefore, permitting a sharp increase in metal temperature. Hot spots then develop and severe knocking ensues. The system of the present invention, however, overcomes this problem by distributing and pumping the coolant at a flow rate so as to maintain nucleate boiling conditions on engine surface areas that undergo a substantial heat flux, such as on the engine cylinder heads, under severe operating conditions, as will be described further below.

One advantage of the cooling system of the present invention, is that there is no need for a condenser mounted above the engine to condense the vaporized coolant. Instead, because of the coolant flow rate and distribution, the vaporized coolant is condensed within either the head coolant jacket 30, or the block coolant jacket 22 by the liquid coolant. In the hotter regions of the cylinder head 26, such as over the combustion chamber domes 27, or around the exhaust runners, some coolant inevitably vaporizes under all operating conditions. However, by employing the system of the present invention, substantially all of the coolant is maintained at a temperature below its saturation temperature. Therefore, substantially all of the vapor formed in the hot regions condenses in the liquid coolant.

Moreover, the flow rate and distribution of coolant in the present invention makes the flow relatively turbulent in comparison to typical water-based coolant systems. The turbulent flow agitates the coolant vapor on the metal surfaces of the engine and thus typically increases both the rate of heat exchange between the vapor and liquid coolant and the occurrence of nucleate boiling.

Figure 4:
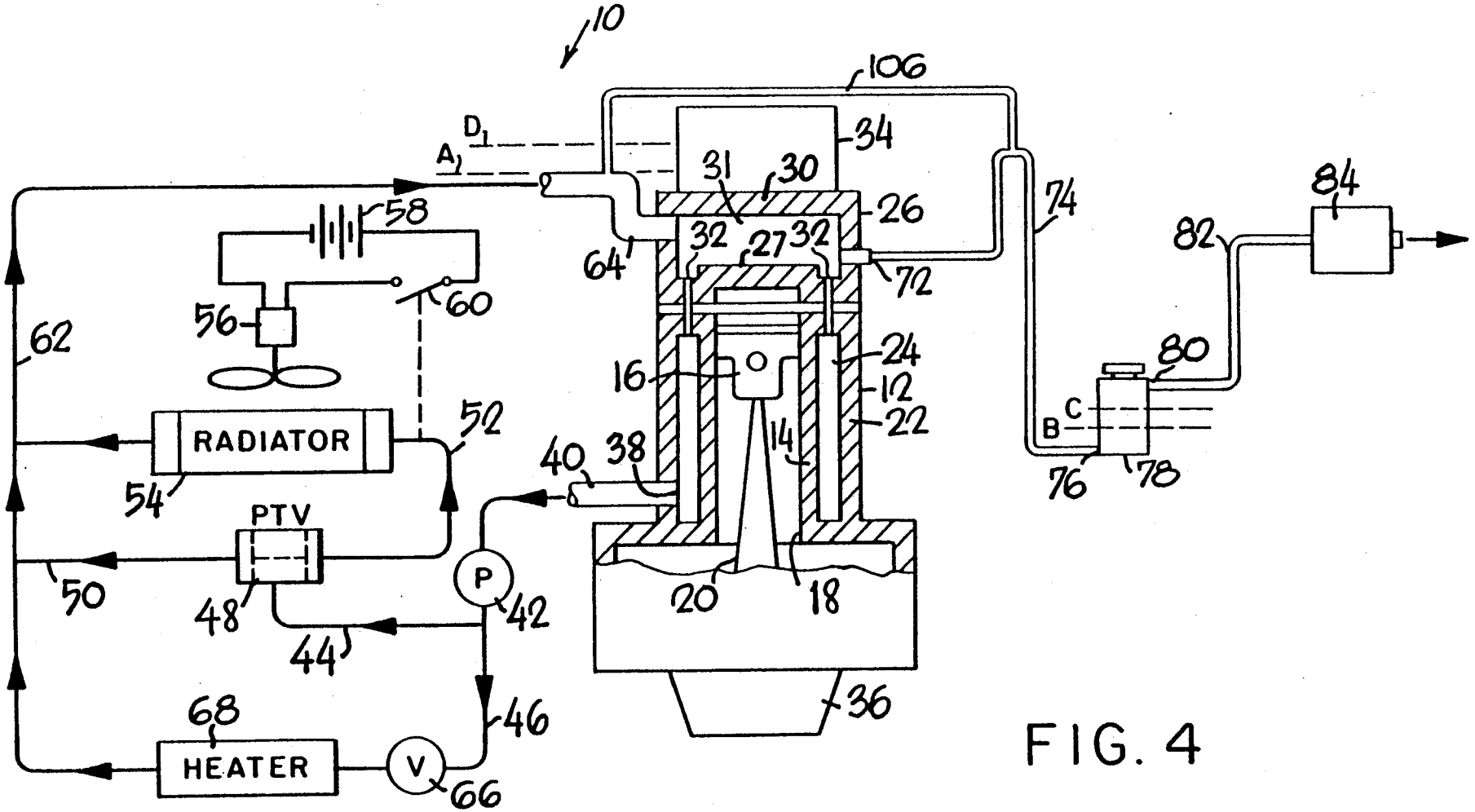
FIG. 4 is a schematic, partial cross-sectional view of another engine embodying the cooling system of the present invention.

In FIG. 4, another engine embodying the cooling system of the present invention is indicated generally by the reference numeral 10. The engine 10 is substantially the same as the engine described above in relation to FIGS. 1 through 3 and, therefore, like reference numerals are used to indicate like elements. The engine 10 of FIG. 4 differs from the engine described above in that it includes a bleed line 106 instead of the air bleed valve 70. The bleed line 106 is coupled on one end to the input line 62, at or above the highest coolant level A. The other end of the bleed line 106 is coupled to the first vent line 74. Although the bleed line 106 rises above the highest coolant level A, it can be coupled at any point along the first vent line 74, or it can be coupled directly to the expansion tank 78.

In the event that there is a leak of noncondensible gases into the cooling system, the bleed line 106 exhausts any such gases from the system. Noncondensible gases can become trapped when filling the system with coolant or can leak into the system during the operation of the engine. For example, a head gasket or combustion chamber leak, or leak caused by a loose joint in a coolant line, can result in an uncontrollable leak of noncondensible gases into the cooling system.

The noncondensible gases within the cooling system flow into the bleed line 106, through the first vent line 74, and into the expansion tank 78. The coolant, however, does not pass through the bleed line 106, but rises to a level D, as indicated by the dotted line in FIG. 4. The level D is about equal in height to the highest point of the first vent line 74. Because the bleed line 106 is only required to pass small volumes of gas or vapor, it can have a relatively small diameter, typically less than ⅛ of an inch. It should be noted, however, that the use of the bleed line 106 can be obviated by locating the first vent port 72 above the level of the input line 62. The system could then essentially purge itself of noncondensible gases.

Figure 5:
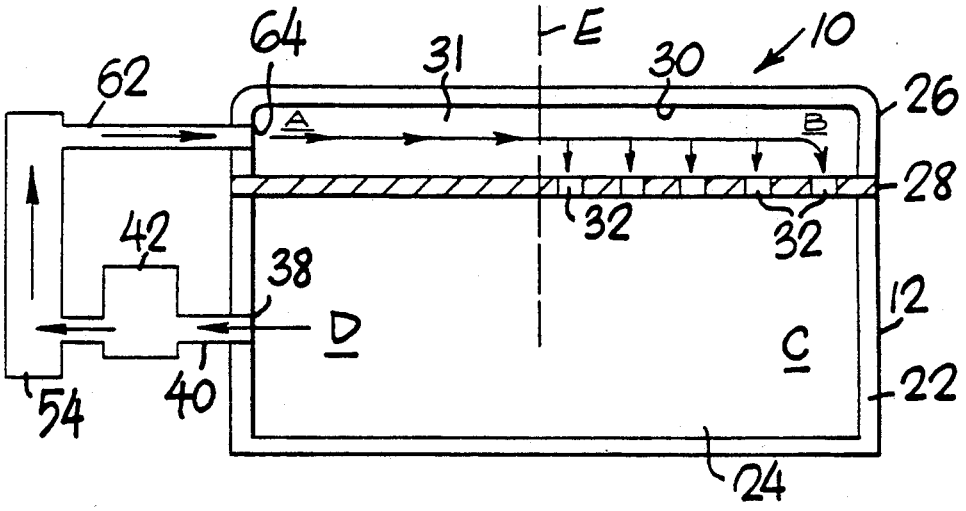
FIG. 5 is a schematic cross-sectional view of the engine of FIG. 1.

Turning to FIG. 5, the flow pattern of the coolant through the head gasket 28 is shown in further detail. The engine 10 is divided in half by a dotted line E, and is further divided into four quadrants A, B, C, and D. Quadrant A is approximately the front half of the cylinder head coolant chamber 31, and quadrant B is the back half of that chamber. Quadrant D is the front half of the engine block coolant chamber 24, and quadrant C is the back half of that chamber. The head gasket 28 is a rear-flow gasket; it is adapted so that the coolant flowing from the head coolant chamber 31 into the block coolant chamber 24, can only flow between the quadrants B and C. The coolant ports 32 extending through the head gasket 28 are only located on, or to the right side of the line E; that is, in the rear half of the engine 10. As described above, in the operation of the engine 10, the coolant flows through the inlet port 64 and into the cylinder head coolant chamber 31. The coolant then must flow into quadrant B before it can flow down through the coolant ports 32 and into the engine coolant chamber 24. The coolants used in the cooling system of the present invention, such as propylene glycol, are relatively viscous. The suction forces of the pump 42 are therefore highest in quadrant D, which is immediately upstream from the inlet port of the pump. If the coolant ports 32 were to extend through the gasket 28 in quadrant A, the high suction forces in quadrant D would cause most of the coolant to flow directly from quadrant A to quadrant D, thus avoiding quadrants B and C. As a result, the temperatures of the engine surfaces would tend to be higher in quadrants B and C, as compared to quadrants A and D. This problem is solved with the rear-flow head gasket 28, shown in further detail in FIG. 6. The head gasket 28 is shaped to correspond to the matching surface areas of the cylinder head 26 and the engine block 12. The head gasket 28 defines four cylinder holes 110 extending therethrough. The cylinder holes 110 are spaced apart from each other and dimensioned to fit around the respective cylinder bores 18 and pistons 16. The head gasket 28 further includes several bolt holes (not shown) to facilitate mounting the cylinder head 26 to the engine block 12.

As shown in FIG. 6, the coolant ports 32 extend through the head gasket 28 only on, or to the left side of the line E; that is, substantially in quadrant B, and not in quadrant A. The size of the coolant ports 32 vary, and each port is sized so that the flow distribution of coolant through the head gasket 28 achieves optimum heat transfer, as will be described further below. The larger diameter coolant ports 32 permit more coolant to flow through that section of the gasket 28 as compared to a section having a smaller sized port. The larger coolant ports 32 are therefore positioned where the coolant flow rate might naturally be lower because of flow restrictions caused by surrounding engine parts, or in hotter regions of the engine.

Figure 7:
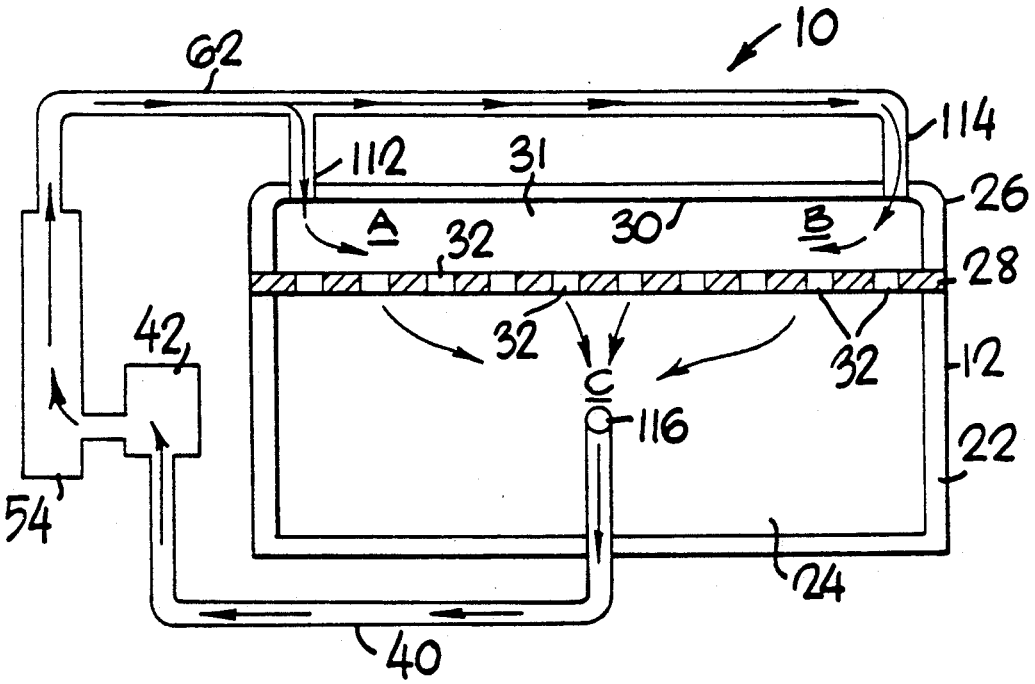
FIG. 7 is a schematic cross-sectional view of another engine embodying the cooling system of the present invention.

In FIG. 7, another engine embodying a cooling system of the present invention is indicated generally by the reference numeral 10. The engine 10 is substantially the same as the engines described above in relation to the previous embodiments and, therefore, like reference numerals are used to indicate like elements. The engine 10 of FIG. 7 is different than the engines described above in that the input line 62 extends above the cylinder head 26. The input line 62 is coupled to a first input port 112 and a second input port 114.

The first input port 112 extends through the head coolant jacket 30, and into the head coolant chamber 31, in the front of the engine 10. The coolant flowing through the first input port 112 thus flows into a section A of the head coolant chamber 31, located in the front of the engine. The second input port 114 extends through the head coolant jacket 30, and into the head coolant chamber 31 in the rear of the engine. Thus, the coolant flowing through the second input port 114 flows into a section B of the head coolant chamber 31, located in the opposite end of the engine of section A.

The engine 10 further includes a coolant outlet port 116 extending through the engine block 12 and block coolant jacket 22. The coolant outlet port 116 is located at about the middle of the block coolant chamber 24. Therefore, it is located about half-way between the top and bottom of the engine block, and about half-way between the front and back of the engine block. The coolant outlet port 116 is coupled to the first coolant line 40, which is in turn coupled to the inlet port of the pump 42. The suction forces of the pump 42 are therefore highest in a section C of the block coolant chamber 24, surrounding the coolant outlet port 116, as shown in FIG. 7. In FIG. 8, the head gasket 28 of FIG. 7 is shown in further detail. The coolant ports 32 are distributed in substantially the same way on the front section as on the rear section of the head gasket 28.

In the operation of the engine 10, the coolant flowing through the first inlet port 112 and the second inlet port 114 flows down through the coolant ports 32, as indicated by the arrows in FIG. 7. The coolant then flows into the block coolant chamber 24, and in turn into the coolant outlet port 116. Because of the location of the first and second inlet ports 112 and 114, respectively, and the location of the coolant outlet port 116, there is a substantially evenly distributed flow of coolant through the head coolant chamber 31 and the block coolant chamber 24. Accordingly, there is no need to place the coolant ports 32 on only one side of the engine, as shown in FIGS. 5 and 6. However, as will be recognized by those skilled in the art, the rear-flow head gasket 28 of FIG. 6 is particularly suitable for use in converting an engine with a conventional cooling system to operate in accordance with the present invention The head gasket of FIG. 8, on the other hand, is usually better suited for an engine originally built in accordance with the present invention.

A test procedure for determining the optimum coolant flow rates and flow distribution for a typical engine to operate in accordance with the present invention is hereinafter described. For purposes of illustration, the test procedure is described with reference to the engine 10 of FIG. 1. The test engine is a 350 cubic inch, V-8, constructed with a compression ratio of 10:1. The engine is filled with a propylene glycol coolant to the level A, and to the level B in the expansion tank 78, as shown in FIG. 1. During the operation of the engine, the coolant will expand and thus rise in the expansion tank 78 to a level between the levels B and C. A rear-flow head gasket, like the head gasket 28 in FIG. 6, is also installed, and the coolant system is operated at open or atmospheric pressure.

For the 350 cubic inch, V-8 test engine, a coolant pump capable of achieving about a 63 GPM flow rate at about a 100° C. coolant outlet temperature, at about 5,200 RPM is used. The test coolant pump is capable of operating at incrementally increasing flow rates, for example, by installing different size drive pulleys to change the speed of rotation of the pump's impeller One such pump is model number 1P798, available from Teel pump Manufacturing Co., of Springfield, Mass. The coolant pump is mounted adjacent to the side of the engine block and is belt-driven by the engine.

In FIG. 9, the left cylinder head of the test engine is illustrated, the front of the cylinder head being indicated by the arrow. There are three thermocouples A, B and C (illustrated schematically) mounted to each cylinder head at critical heat flux areas. The thermocouple B is located between the two center cylinders and the thermocouples A and C are located on the front and rear cylinders, respectively. There are additional thermocouples (not shown) mounted to the coolant input port 64 and the coolant outlet port 38, to measure the bulk coolant temperature in each location.

The test procedure is conducted by running the test engine on a dynamometer (not shown), such as a Super Flow 901 Dynomometer, with standard octane fuel (91 octane), and standard engine oil (5W/30). A liquid-to-liquid heat exchanger (not shown) is coupled to the engine in place of a radiator. The liquid-to-liquid heat exchanger is adjustable so that coolant temperatures can be varied to simulate steady state radiator conditions. The oil temperature is permitted to rise with coolant temperature. However, a liquid-to-oil cooling circuit (not shown) is preferably employed to cool the oil between tests so that several tests can be run in a single day. A fixed-advance electronic ignition system and knock sensor circuitry (not shown) are employed to maintain the ignition setting at a constant level throughout the test procedure. A clear sight chamber (not shown) is installed in the coolant expansion vent line 74 to observe the existence, or nonexistence of vapor exiting the engine.

The test engine is evaluated under both a wide-open throttle test (WOT) and a part-open throttle test (POT). Adjustable in-line flow restrictors are coupled to a positive displacement flow meter (not shown) installed immediately downstream of the outlet port of the pump, to measure the coolant flow rate.

During the WOT test, the engine is operated at the following three test points, at different bulk coolant temperature increments for each test point:

1) 2,400 RPM at full load (about 125 HP);
2) 3,200 RPM at full load (about 171 HP); and
3) 4,000 RPM at full load (about 227 HP).

An initial determination of the optimum coolant flow rates for each WOT test point is made. Starting at a coolant outlet temperature baseline of about 190° F., the engine is operated at 10° F. temperature increments at each test point. The coolant temperature is controlled by adjusting the liquid-to-liquid heat exchanger. The coolant flow rate is incrementally increased at each 10° F. temperature increment. The corresponding cylinder head temperatures, as indicated by the thermocouples A, B and C, are recorded. The coolant temperature is increased until the outlet temperature falls within the range of about 270°-280° F.

The coolant flow rate is incrementally increased by installing incrementally smaller drive pulleys on the pump. The smaller the drive pulley, the faster is the rotational speed of the pump's impeller. The pump speed and, therefore, coolant flow rate is increased at each coolant temperature increment until the engine metal temperatures stabilize, as indicated by the thermocouples A, B and C. Stability is achieved typically when there is less than a 10° F. change in metal temperature, for a 10 GPM change in coolant flow rate, thus indicating an optimum coolant flow rate. The inline flow restrictor can be used to fine tune the coolant flow rate between the flow rates of two successive pump pulleys. When approaching the optimum flow rate at any operating load, no vapor should appear in the clear sight chamber installed in the coolant expansion vent line (the first vent line 74 in FIG. 1).

At each coolant outlet temperature increment, the normal engine parameters, as indicated by the dynamometer are also recorded, as indicated in the tables below. The spark setting, along with the coolant temperatures entering the cylinder head and exiting the engine block, are also recorded. If there is an observed engine "knock", the spark setting is retarded to diminish the knock. The spark setting and engine functions are then again recorded.

Then, after initially identifying the optimum coolant flow rates for each WOT test point, the optimum coolant flow distribution through the engine block, cylinder head, and head gasket is established, as hereinafter described. The engine is operated again at 10° F. coolant outlet temperature increments at each of the three WOT test points. The engine is operated throughout the same coolant outlet temperature range as described above, while recording the same test data at each increment.

However, the cross-sectional flow area of each coolant port extending from the cylinder head, through the head gasket, and into the engine block (coolant ports 32 in FIG. 1), is incrementally increased by about 15% at each 10° F. coolant outlet temperature increment, until the engine metal temperatures, as indicated by the thermocouples A, B and C, stabilize. Stabilization is achieved typically when there is less than a 10° F. change in metal temperature, for each 15% increase in flow area, thus indicating an optimum coolant distribution. If one of the thermocouples A, B or C continues to maintain a higher temperature reading than the others, or if its temperature reading does not change as much as the others, the associated coolant ports will likely require a greater increase in flow area.

Once the optimum coolant flow distribution is established at each coolant outlet temperature increment for each WOT test point, the optimum coolant flow rates for each test point are again determined. Thus, the engine is operated again at each of the three WOT test points, at 10° F. coolant outlet temperature increments throughout the same temperature range as described above. At each 10° F. temperature increment, the coolant flow rate is incrementately increased until the metal temperatures stabilize, and the data is recorded, in the same manner as described above. Thus, a final determination of the optimum coolant flow rates is made based on the optimum coolant flow distribution.

The tables below illustrate the final WOT test data for the test engine:

| | | WOT Test Point 1 (2400 RPM at 125 HP) | | | | | | | |
|---|---|---|---|---|---|---|---|---|---|
| | | Metal Temperature - Head (°F.) (Thermocouples A, B and C) | | | | | | | |
| | | LEFT | | | RIGHT | | | | TQ |
| Coolant Out (°F.) | Knock | A | B | C | A | B | C | HP | (ft. lbs) |

-continued

| | | | | | | | | | |
|---|---|---|---|---|---|---|---|---|---|
| 190 | CL | 296 | 514 | 448 | 318 | 509 | 347 | 124.8 | 270.3 |
| 200 | CL | 306 | 529 | 456 | 331 | 519 | 368 | 125.1 | 271.4 |
| 210 | CL | 321 | 535 | 461 | 346 | 527 | 373 | 124.8 | 272.5 |
| 220 | CL | 330 | 545 | 468 | 355 | 534 | 380 | 125.4 | 272.6 |
| 230 | CL | 340 | 554 | 477 | 361 | 543 | 381 | 124.8 | 271.8 |
| 240 | CL | 336 | 548 | 476 | 358 | 534 | 375 | 124.6 | 270.9 |
| 250 | CL | 347 | 555 | 483 | 365 | 545 | 385 | 125.1 | 269.5 |
| 260 | CL | 356 | 568 | 496 | 374 | 554 | 385 | 124.7 | 269.6 |
| 270 | CL | 359 | 575 | 499 | 381 | 558 | 391 | 124.9 | 269.7 |
| 280 | CL | 368 | 583 | 504 | 392 | 568 | 397 | 125.1 | 268.8 |

| Coolant Out (°F.) | Coolant In (°F.) | Oil Temp. (°F.) | Fuel (Lb/Hr) | Air (SCFM) | A/F | CAT (°F.) | BSFC | Coolant Outlet Flow Rate (GPM) |
|---|---|---|---|---|---|---|---|---|
| 190 | 180 | 190 | 72.5 | 169.3 | 10.6 | 93 | .59 | 39.4 |
| 200 | 190 | 200 | 71.8 | 168.9 | 10.8 | 91 | .57 | 39.6 |
| 210 | 200 | 200 | 73.1 | 170.2 | 10.7 | 91 | .58 | 39.7 |
| 220 | 210 | 200 | 71.1 | 170.1 | 11.0 | 92 | .56 | 40.0 |
| 230 | 220 | 210 | 71.0 | 168.9 | 10.9 | 92 | .56 | 40.2 |
| 240 | 230 | 210 | 73.7 | 168.3 | 10.5 | 92 | .59 | 40.2 |
| 250 | 240 | 210 | 73.0 | 168.8 | 10.6 | 93 | .58 | 40.4 |
| 260 | 250 | 210 | 72.9 | 168.4 | 10.6 | 93 | .58 | 40.6 |
| 270 | 270 | 220 | 71.7 | 169.0 | 10.8 | 93 | .57 | 40.9 |
| 280 | 270 | 220 | 72.0 | 169.0 | 10.2 | 93 | .58 | 41.0 |

wherein

"Coolant Out" is the coolant outlet temperature;

"HP" is horsepower;

"TQ" is torque;

"Coolant In" is the coolant inlet temperature;

"Oil Temp." is the temperature of the oil as measured by a thermocouple (not shown) mounted on the oil pan;

"Fuel" is the fuel consumption rate;

37 Air" is the air flow rate into the engine's carburetor;

"A/F" is the air-to-fuel ratio;

"CAT" is the temperature of the air flowing into the carburetor;

"BSFC" is the brake Specific Fuel Consumption, which is the amount of fuel used per HP per hour (GPH/HR); and "CL" means that the knock is clear or, that is, there is no observed knock.

WOT Test Point 2 (3200 RPM at 171 HP)

| Coolant Out (°F.) | Knock | Metal Temperature - Head (°F.) (Thermocouples A, B and C) LEFT A | LEFT B | LEFT C | RIGHT A | RIGHT B | RIGHT C | HP | TQ (ft. lbs) |
|---|---|---|---|---|---|---|---|---|---|
| 190 | CL | 303 | 550 | 475 | 339 | 552 | 399 | 170.6 | 275.6 |
| 200 | CL | 312 | 562 | 486 | 350 | 562 | 407 | 171.2 | 278.4 |
| 210 | CL | 323 | 569 | 493 | 364 | 573 | 417 | (_)+ | (_)+ |
| 220 | CL | 330 | 571 | 500 | 366 | 576 | 418 | 171.8 | 279.1 |
| 230 | CL | 340 | 579 | 502 | 374 | 578 | 420 | 171.3 | 278.5 |
| 240 | CL | 348 | 584 | 507 | 381 | 586 | 426 | (_)+ | (_)+ |
| 250 | CL | 359 | 588 | 515 | 392 | 596 | 435 | 170.5 | 274.8 |
| 260 | CL | 372 | 591 | 522 | 399 | 602 | 443 | (_)+ | (_)+ |
| 270 * | CL | 364 | 598 | 523 | 391 | 608 | 440 | 172.2 | 279.7 |

| Coolant Out (°F.) | Coolant In (°F.) | Oil Temp. (°F.) | Fuel (Lb/Hr) | Air (SCFM) | A/F | CAT (°F.) | BSFC | Coolant Outlet Flow Rate (GPM) |
|---|---|---|---|---|---|---|---|---|
| 190 | 180 | 240 | 97.9 | 245.2 | 11.4 | 91 | .57 | 47.8 |
| 200 | 190 | 240 | 96.4 | 245.1 | 11.6 | 91 | .57 | 47.9 |
| 210 | 200 | 240 | (_)+ | (_)+ | (_)+ | (_)+ | (_)+ | 48.0 |
| 220 | 210 | 240 | 97.9 | 243.3 | 11.4 | 91 | .57 | 48.2 |
| 230 | 220 | 250 | 96.5 | 243.7 | 11.6 | 92 | .57 | 48.2 |
| 240 | 230 | 250 | (_)+ | (_)+ | (_)+ | (_)+ | (_)+ | 48.4 |
| 250 | 240 | 250 | 98.4 | 244.9 | 11.5 | 92 | .59 | 48.6 |
| 260 | 250 | 260 | (_)+ | (_)+ | (_)+ | (_)+ | (_)+ | 48.6 |
| 270 | 260 | 260 | 98.0 | 243.9 | 11.4 | 93 | .57 | 48.7 |

(_)+ indicates no data available.

*Test ended.

WOT Test Point 3 (4,000 RPM at about 227 HP)

| Coolant | Metal Temperature - Head (°F.) (Thermocouples A, B and C) LEFT | RIGHT | TQ |
|---|---|---|---|

-continued

| Out (°F.) | Knock | A | B | C | A | B | C | HP | (ft-lbs) |
|---|---|---|---|---|---|---|---|---|---|
| 190 | CL | 326 | 614 | 529 | 369 | 629 | 415 | 226.8 | 296.0 |
| 200 | CL | 332 | 622 | 536 | 377 | 628 | 418 | 227.6 | 295.2 |
| 210 | CL | 336 | 623 | 516 | 372 | 628 | 418 | 226.1 | 291.3 |
| 220 | CL | 346 | 655 | 527 | 384 | 651 | 420 | 226.4 | 294.2 |
| 230 | CL | 349 | 663 | 539 | 388 | 663 | 422 | 225.8 | 294.9 |
| 240 | CL | 357 | 668 | 554 | 392 | 667 | 432 | 226.4 | 295.8 |
| 250 | CL | 359 | 672 | 559 | 393 | 675 | 439 | 226.9 | 295.6 |
| 260 * | CL | 363 | 677 | 564 | 396 | 679 | 448 | 226.7 | 293.2 |

| Coolant Out (°F.) | Coolant In (°F.) | Oil Temp. (°F.) | Fuel (Lb/Hr) | Air (SCFM) | A/F | CAT (°F.) | BSFC | Coolant Outlet Flow Rate (GPM) |
|---|---|---|---|---|---|---|---|---|
| 190 | 180 | 240 | 129.1 | 319.1 | 11.3 | 95 | .58 | 49.0 |
| 200 | 190 | 240 | 129.0 | 329.1 | 11.7 | 96 | .57 | 49.2 |
| 210 | 200 | 240 | 130.6 | 332.7 | 11.7 | 95 | .57 | 49.3 |
| 220 | 210 | 240 | 129.5 | 331.0 | 11.7 | 96 | .56 | 49.9 |
| 230 | 220 | 250 | 131.4 | 330.5 | 11.6 | 96 | .57 | 51.0 |
| 240 | 230 | 250 | 131.3 | 331.1 | 11.6 | 97 | .57 | 51.3 |
| 250 | 240 | 250 | 130.6 | 328.7 | 11.6 | 98 | .57 | 51.3 |
| 260 * | 250 | 250 | 130.2 | 325.6 | 11.5 | 98 | .57 | 51.5 |

*Test ended.

The same procedure is then repeated for the following POT test points:

1) 1,400 RPM at 16.8 IN/HG;
2) 1,475 RPM at 16.0 IN/HG; and
3) 1,700 RPM at 14.3 IN/HG.

The tables below illustrate the POT test data for the test engine:

POT Test Point 1 (1400 RPM at 16.8 In/HG - 40° Fixed Spark)

| Coolant Out (°F.) | Knock | Metal Temperature - Head (°F.) (Thermocouples A, B and C) LEFT A | LEFT B | LEFT C | RIGHT A | RIGHT B | RIGHT C | HP | TQ (ft. lbs) |
|---|---|---|---|---|---|---|---|---|---|
| 190 | CL | 246 | 314 | 308 | 250 | 309 | 303 | 16.8 | 62.1 |
| 200 | CL | 250 | 319 | 316 | 259 | 318 | 314 | 16.3 | 60.5 |
| 210 | CL | 260 | 327 | 323 | 264 | 328 | 317 | 16.3 | 60.4 |
| 220 | CL | 265 | 332 | 329 | 276 | 328 | 320 | 17.0 | 62.5 |
| 230 | CL | 277 | 338 | 331 | 285 | 331 | 323 | 16.3 | 60.5 |
| 240 | CL | 282 | 341 | 336 | 292 | 336 | 325 | 16.9 | 62.0 |
| 250 | CL | 293 | 346 | 342 | 302 | 338 | 329 | 16.7 | 61.6 |
| 260 | CL | 304 | 352 | 342 | 309 | 341 | 332 | 16.5 | 60.9 |
| 270 | CL | 313 | 358 | 345 | 319 | 347 | 339 | 17.1 | 63.4 |
| 280 | CL | 327 | 364 | 348 | 332 | 354 | 346 | 17.0 | 62.8 |

| Coolant Out (°F.) | Coolant In (°F.) | Oil Temp. (°F.) | Fuel (Lb/Hr) | Air (SCFM) | A/F | CAT (°F.) | BSFC | Coolant Outlet Flow Rate (GPM) |
|---|---|---|---|---|---|---|---|---|
| 190 | 180 | 200 | 11.5 | 36.7 | 14.6 | 92 | .73 | 16.8 |
| 200 | 190 | 210 | 11.4 | 36.7 | 14.8 | 94 | .72 | 16.9 |
| 210 | 210 | 220 | 11.3 | 36.7 | 14.9 | 94 | .74 | 16 9 |
| 220 | 220 | 230 | 11.4 | 36.5 | 14.7 | 96 | .72 | 17.0 |
| 230 | 230 | 240 | 11.3 | 36.2 | 15.1 | 94 | .74 | 17.0 |
| 240 | 230 | 240 | 11.0 | 35.8 | 14.7 | 96 | .73 | 17.0 |
| 250 | 240 | 240 | 11.2 | 35.7 | 14.9 | 94 | .73 | 17.1 |
| 260 | 250 | 250 | 11.0 | 35.8 | 14.9 | 95 | .75 | 17.2 |
| 270 | 260 | 250 | 11.0 | 36.0 | 14.5 | 96 | .76 | 17.3 |
| 280 | 270 | 260 | 11.2 | 36.3 | 14.7 | 96 | .76 | 17.4 |

POT Test Point 2 (1475 RPM at 16 In/HG - 42° Fixed Spark)

| Coolant Out (°F.) | Knock | Metal Temperature - Head (°F.) (Thermocouples A, B and C) LEFT A | LEFT B | LEFT C | RIGHT A | RIGHT B | RIGHT C | HP | TQ (ft. lbs) |
|---|---|---|---|---|---|---|---|---|---|
| 190 | CL | 254 | 329 | 323 | 261 | 324 | 317 | 20.4 | 71.0 |
| 200 | CL | 260 | 333 | 329 | 268 | 331 | 326 | 20.3 | 70.6 |
| 210 | CL | 271 | 342 | 338 | 275 | 340 | 332 | 19.8 | 69.3 |
| 220 | CL | 277 | 347 | 341 | 284 | 345 | 333 | 20.6 | 71.4 |
| 230 | CL | 284 | 351 | 342 | 296 | 352 | 338 | 19.8 | 69.4 |
| 240 | CL | 293 | 356 | 350 | 299 | 355 | 341 | 21.3 | 73.9 |

-continued

| | | | | | | | | | |
|---|---|---|---|---|---|---|---|---|---|
| 250 | CL | 302 | 360 | 357 | 310 | 356 | 343 | 20.8 | 72.8 |
| 260 | CL | 311 | 364 | 357 | 320 | 359 | 349 | 20.8 | 72.8 |
| 270 | CL | 320 | 373 | 360 | 329 | 362 | 351 | 19.7 | 70.4 |
| 280 | CL | 328 | 380 | 367 | 341 | 369 | 358 | 19.7 | 69.9 |

| Coolant Out (°F.) | Coolant In (°F.) | Oil Temp. (°F.) | Fuel (Lb/Hr) | Air (SCFM) | A/F | CAT (°F.) | BSFC | Coolant Outlet Flow Rate (GPM) |
|---|---|---|---|---|---|---|---|---|
| 190 | 190 | 200 | 13.0 | 41.0 | 14.5 | 89 | .67 | 18.1 |
| 200 | 190 | 210 | 12.8 | 41.0 | 14.7 | 89 | .67 | 18.1 |
| 210 | 200 | 220 | 12.5 | 40.9 | 15.0 | 90 | .66 | 18.3 |
| 220 | 210 | 220 | 12.8 | 41.4 | 14.8 | 91 | .65 | 18.3 |
| 230 | 220 | 230 | 13.0 | 41.4 | 14.6 | 91 | .71 | 18.3 |
| 240 | 230 | 240 | 12.9 | 41.3 | 14.7 | 92 | .64 | 18.5 |
| 250 | 250 | 240 | 12.9 | 41.3 | 14.7 | 92 | .66 | 18.5 |
| 260 | 250 | 250 | 12.8 | 41.4 | 14.8 | 91 | .65 | 18.6 |
| 270 | 270 | 250 | 12.9 | 41.4 | 14.7 | 92 | .69 | 18.7 |
| 280 | 270 | 250 | 12.5 | 40.1 | 14.7 | 92 | .67 | 18.9 |

POT Test Point 3 (1700 RPM at 14.3 In/HG - 44° Fixed Spark)

| Coolant Out (°F.) | Knock | Metal Temperature - Head (°F.) (Thermocouples A, B & C) LEFT A | LEFT B | LEFT C | RIGHT A | RIGHT B | RIGHT C | HP | TQ (ft. lbs) |
|---|---|---|---|---|---|---|---|---|---|
| 190 | CL | 275 | 340 | 314 | 287 | 325 | 318 | 31.7 | 97.4 |
| 200 | CL | 277 | 345 | 319 | 288 | 331 | 323 | 32.4 | 99.6 |
| 210 | CL | 285 | 348 | 322 | 295 | 335 | 324 | 31.9 | 97.4 |
| 220 | CL | 293 | 351 | 334 | 302 | 339 | 336 | 31.6 | 99.3 |
| 230 | CL | 302 | 359 | 342 | 310 | 344 | 340 | 31.9 | 97.1 |
| 240 | CL | 309 | 366 | 345 | 316 | 352 | 344 | 32.1 | 98.7 |
| 250 | CL | 319 | 371 | 352 | 325 | 358 | 350 | 33.2 | 102.5 |
| 260 | CL | 331 | 374 | 355 | 336 | 362 | 352 | 33.2 | 97.7 |
| 270 | CL | 339 | 378 | 358 | 343 | 367 | 355 | 31.8 | 95.6 |
| 280 | CL | 348 | 380 | 361 | 351 | 371 | 356 | 31.6 | 95.4 |

| Coolant Out (°F.) | Coolant In (°F.) | Oil Temp. (°F.) | Fuel (Lb/Hr) | Air (SCFM) | A/F | CAT (°F.) | BSFC | Coolant Outlet Flow Rate (GPM) |
|---|---|---|---|---|---|---|---|---|
| 190 | 180 | 210 | 18.0 | 55.1 | 14.3 | 92 | .60 | 25.2 |
| 200 | 190 | 220 | 17.9 | 55.2 | 14.4 | 92 | .58 | 25.2 |
| 210 | 200 | 220 | 17.8 | 55.3 | 14.5 | 92 | .59 | 25.4 |
| 220 | 220 | 230 | 17.7 | 55.2 | 14.5 | 93 | .57 | 25.5 |
| 230 | 220 | 230 | 17.8 | 55.2 | 14.4 | 93 | .59 | 25.7 |
| 240 | 230 | 240 | 18.0 | 55.6 | 14.4 | 92 | .59 | 25.9 |
| 250 | 240 | 240 | 18.1 | 56.0 | 14.4 | 94 | .57 | 25.9 |
| 260 | 250 | 250 | 18.0 | 55.8 | 14.4 | 94 | .59 | 25.9 |
| 270 | 270 | 250 | 17.4 | 54.1 | 14.5 | 94 | .50 | 26.1 |
| 280 | 270 | 260 | 17.5 | 54.1 | 14.2 | 94 | .61 | 26.2 |

Therefore, the optimum coolant flow rates and the optimum coolant flow distribution is determined for each temperature increment for each test point under both the WOT and POT tests. Once the optimum coolant flow rates are determined, the coolant pump is designed so that critical engine operating points, as set by the vehicle manufacturer, will be substantially maintained. The A/F, spark, and BSFC values are usually considered important because their stability under different operating loads is proportional to fuel economy and emissions output. Oil temperature stability under 138° C. at all coolant temperatures is also important.

The pump 42 is then designed so that its performance substantially corresponds to the optimum coolant flow rates at each critical engine operating point. Typically, however, the pump flow rates are maintained as close as possible to the optimum flow rates for the WOT test points. Insufficient flow rates under the WOT test points are likely to be more disadvantageous than proportionally insufficient flow rates under the POT test points. However, if the pump flow rates are substantially higher than the optimum flow rates for the POT test points, then the engine may lose fuel economy by driving the pump too fast at lower engine speeds. Therefore, the performance characteristics of the pump must be balanced between the optimum WOT and POT test point flow rates.

Figure 10:
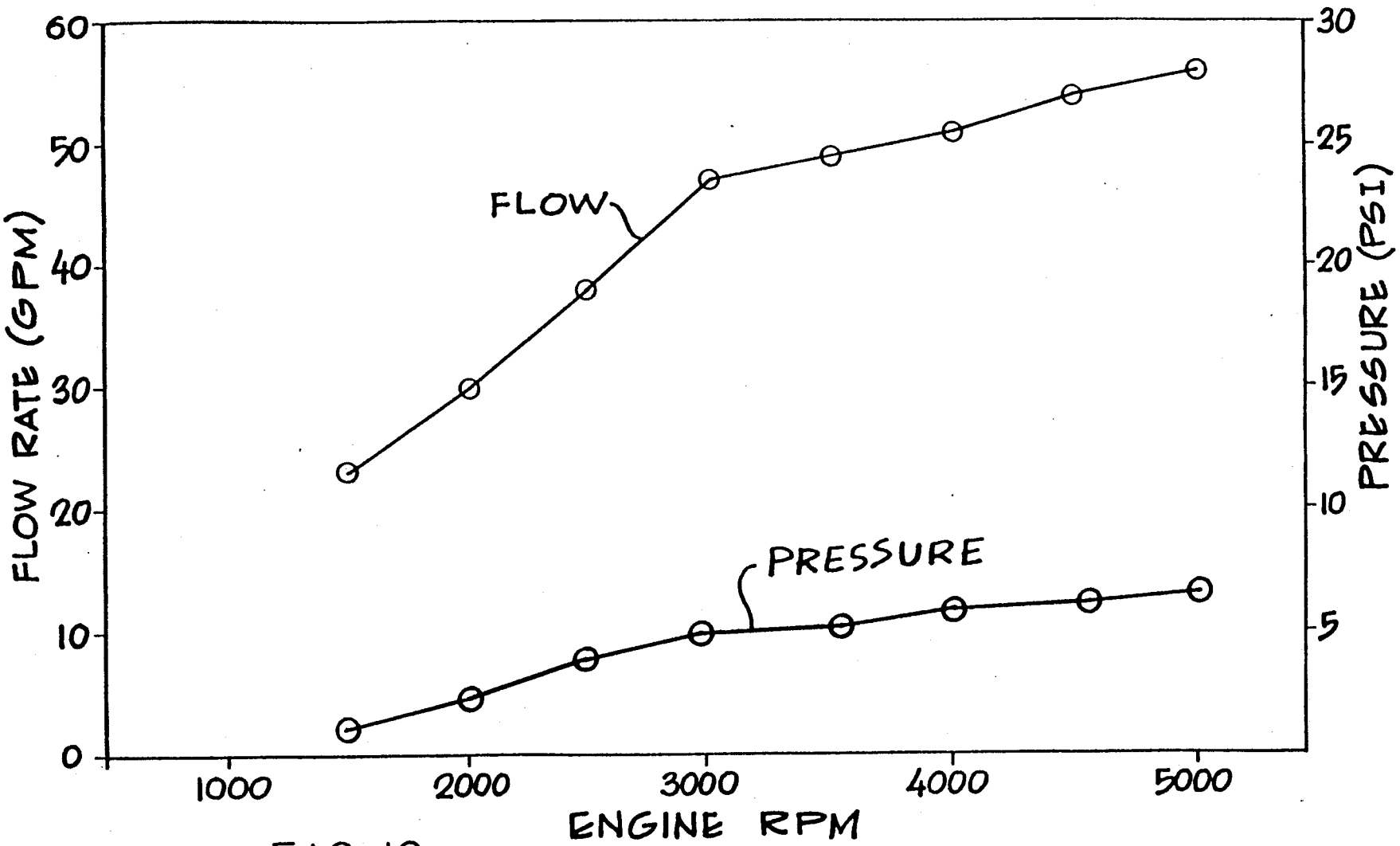
FIG. 10 is a graph illustrating the flow and pressure characteristics of a coolant pump in accordance with the present invention.

The optimum coolant flow rates (GPM) are preferably plotted as a function of engine speed (RPM) and as a function of coolant outlet temperature (° F.) at the different WOT and POT test points (not shown). Based on the plotted data, the desired flow rates and pressure characteristics of the pump are plotted as a function of engine speed, as shown in FIG. 10. The pressure plot in FIG. 10 is the coolant pressure on the outlet side of the pump, when the PTV 48 is closed. The pressure is measured by a pressure gauge (not shown) mounted in the coolant line between the pump and the radiator. The pressure is preferably maintained below about 13 psi under all operating loads. If the pressure reading exceeds that level, the system may require a larger volume radiator to decrease the radiator back pressure.

The pump is then designed so that its performance substantially corresponds to the curves of FIG. 10. For the test engine, a centrifugal-type pump having the following characteristics was found to substantially match the performance curves of FIG. 10 a 5.25 inch diameter by ½ inch deep impeller, with 7 impeller fins, the impeller fins preferably being mounted on a backing plate so that the coolant does not flow around the fins; two 1-⅜ inch diameter coolant inlets and a 1-⅜ inch diameter coolant outlet, the two inlets each being coupled to a respective bank of the V-8 engine; and a 1.9 to 1 overdrive pulley ratio, so that the pump turns about 1.9 revolutions for each engine revolution.

The coolant pump is driven by the engine and, therefore, its speed and flow rate increases with engine speed. The pump speed in a water-based coolant system is frequently limited by the viscosity and boiling point of the coolant. At high engine speeds, when the coolant temperature is highest, if the pump is run too fast, pump cavitation is more likely to occur as the coolant temperature approaches its boiling point.

This problem is substantially avoided with the present invention because the coolants used, such as propylene glycol, are relatively viscous and have high boiling points in comparison to water-based coolants. Therefore, the pump can be run at faster speeds and/or with increased vacuum or suction to produce higher flow rates at all engine speeds, as compared to water-based coolant systems, without the risk of cavitation. Accordingly, because the system of the present invention can be operated at relatively high flow rates, the liquid coolant can condense the vaporized coolant generated upon contact with the surfaces of the engine, under heavy operating loads and/or high ambient temperatures.

One advantage of the present invention is that by determining both the optimum coolant flow rates and flow distribution for a particular engine, as described above, vapor blanketing and, therefore, excessive engine metal temperatures are substantially avoided. Without determining the optimum flow distribution, on the other hand, certain areas of the engine might not receive sufficient coolant flow and, accordingly, give rise to vapor blanketing.

Another advantage of the cooling system of the present invention is that the flow rate and the distribution can be determined to reduce engine metal temperatures to levels believed to be previously unachievable. As a result, the rate of heat exchange between the metal surfaces of the engine and the coolant is increased so that combustion side (flame side) metal temperature spikes are significantly lowered, as compared, for example, to water-based coolant systems. Moreover, the sensitivity of the combustion chambers to variations in bulk coolant temperature, cylinder compression pressures, ignition advance, fuel octane, and lean fuel mixtures, are dramatically reduced. Engine oil temperatures are also typically reduced.

Furthermore, after boil protection is typically increased with the cooling system of the present invention, due to the lower average metal temperatures of the engine, particularly in the cylinder head. After operating under heavy loads and/or high ambient temperatures, the cooling system of the present invention can typically be immediately shut down, without the problem of coolant loss, as might be experienced with a water-based coolant system.

Although the cooling system of the present invention is preferably operated at ambient pressures, it can also be operated under conventional coolant system pressures (about 15–18 psig). The engine metal temperatures are typically lower than with a conventional water-based coolant system. Therefore, although the coolant temperature with the present invention is typically higher, particularly if the system is pressurized, the engine metal temperatures are still maintained at relatively low levels. Accordingly, the problems of detonation and pre-ignition are substantially prevented.

I claim:

1. A condenserless apparatus for cooling an internal combustion engine with a substantially anhydrous, boilable liquid coolant having a saturation temperature higher than that of water, comprising:

a coolant chamber surrounding the cylinder walls and combustion chambers of the engine to receive the coolant for cooling the metal surfaces of the engine;

a coolant pump coupled in fluid communication with the coolant chamber;

a coolant pump coupled in fluid communication with the coolant chamber;

means for exhausting gases or vapor not condensed by the liquid coolant in the coolant chamber therefrom, the means for exhausting being coupled in fluid communication with a section of the apparatus at about ambient pressure or below that pressure and adapted to restrict the return of moisture to the coolant in the coolant chamber, the coolant pump being adapted to pump the coolant through the coolant chamber at a flow rate so that the liquid coolant substantially condenses coolant vaporized upon contact with the metal surfaces of the engine.

2. An apparatus as defined in claim 1, further comprising:

means for distributing coolant through the coolant chamber so that coolant vaporized upon contact with the metal surfaces of the engine substantially condenses in the liquid coolant.

3. An apparatus as defined in claim 2, further comprising:

a radiator coupled in fluid communication with the coolant pump and the coolant chamber, the coolant flowing through the radiator being reduced in temperature by heat exchange therewith.

4. An apparatus as defined in claim 2, wherein the means for exhausting includes:

a conduit coupled in fluid communication with the coolant chamber, the conduit being adapted to receive the gases or vapor in the coolant chamber and to exhaust the gases or vapor from the engine.

5. An apparatus as defined in claim 2, further comprising:

a head gasket seated between a cylinder head and an engine block of the engine; and the means for distributing includes a plurality of coolant apertures extending through the head gasket, each of the coolant apertures being in fluid communication with the coolant chamber to permit coolant to flow therethrough.

6. An apparatus as defined in claim 5, further comprising:

a first coolant inlet in fluid communication with the coolant chamber, the radiator and the pump; and a coolant outlet in fluid communication with the coolant chamber and the pump, the first coolant inlet and the coolant outlet both being located on the same side of the engine, and the coolant apertures extend through a section of the head gasket located adjacent to the side of the engine opposite the side of the first coolant inlet and the coolant outlet.

7. An apparatus as defined in claim 5, further comprising:

a first coolant inlet in fluid communication with the coolant chamber, the radiator and the pump; and a coolant outlet in fluid communication with the coolant chamber and the pump, the coolant outlet being located at about the midpoint of the coolant chamber measured between a front wall and a rear wall of the engine.

8. An apparatus as defined in claim 7, further comprising:

a second coolant inlet in fluid communication with the coolant chamber, and the radiator and/or the coolant pump, the second coolant inlet being located on the opposite side of the engine of the first coolant inlet.

9. An apparatus as defined in claim 2, wherein the means for exhausting includes:

an expansion tank coupled in fluid communication with the coolant chamber, to receive expanded liquid coolant and/or gases or vapors from the coolant chamber.

10. An apparatus as defined in claim 9, wherein the expansion tank is in fluid communication with the ambient atmosphere and receives liquid coolant therein to maintain a substantially liquid coolant barrier between the coolant chamber and the ambient atmosphere.

11. An apparatus as defined in claim 10, wherein the expansion tank defines an inlet port and an outlet port, the inlet port extending through a bottom wall thereof and being in fluid communication with the coolant chamber, the outlet port extending through a top wall thereof and being in fluid communication with the ambient atmosphere, the inlet port being located below the coolant level in the expansion tank and the outlet port being located above the coolant level in the expansion tank, the liquid coolant in the expansion tank thus providing a liquid seal between the outlet port and the coolant chamber.

12. An apparatus as defined in claim 11, further comprising:

a dehydrating unit coupled in fluid communication with the outlet port of the expansion tank, the dehydrating unit substantially removing the water vapor flowing therethrough and into the outlet port.

13. An apparatus as defined in claim 12, wherein the dehydrating unit includes a desiccant material to substantially remove the water vapor.

14. A method of cooling an internal combustion engine in a condenserless system comprising the following steps:

pumping a substantially anhydrous, boilable liquid coolant, having a saturation temperature higher than that of water, within the engine at a flow rate so that substantially all of the coolant vaporized upon contact with the metal surfaces of the engine is condenses by the liquid coolant;

exhausting gases or vapor not condensed by the liquid coolant in the coolant chamber therefrom, through means for exhausting coupled in fluid communication with a section of the adapted to restrict the return of moisture to the coolant in the coolant chamber.

15. A method as defined in claim 14, further comprising the following step:

distributing the coolant through the engine so that substantially all of the coolant vaporized upon contact with the metal surfaces of the engine is condensed by the liquid coolant.

16. A method as defined in claim 15, further comprising the following step:

exhausting gases or vapor not condensed by the liquid coolant in the coolant chamber therefrom, from a location in the engine at about ambient pressure or below that pressure.

17. A method as defined in claim 15, wherein the coolant is pumped in the direction of the cylinder head toward the engine block of the engine.

18. A method as defined in claim 15, wherein the coolant is pumped in the direction of the engine block toward the cylinder head of the engine.

19. A method as defined in claim 15, further comprising the steps of:

pumping the coolant in the direction of the front of the cylinder head toward the back of the cylinder head, toward the engine block, and in turn toward the front of the engine block.

20. A method as defined in claim 14, wherein the coolant includes at least one substance that is miscible with water and has a vapor pressure substantially less than that of water at any given temperature.

21. A method as defined in claim 20, wherein the substance of the coolant is selected from a group including ethylene glycol, propylene glycol, tetrahydrofurfuryl alcohol, and dipropylene glycol.

22. A method as defined in claim 14, wherein the coolant includes at least one substance that is substantially immiscible with water and has a vapor pressure substantially less than that of water at any given temperature.

23. A method as defined in claim 22, wherein the substance of the coolant is selected from a group including 2,2,4-trimethyl-1,3-pentanediol monoisobutyrate, dibutyl isopropanolamine, and 2-butyl octanol.

24. A process for cooling for a condenserless internal combustion engine, comprising the following steps:

pumping a substantially anhydrous, boilable liquid coolant, having a saturation temperature above that of water, from a coolant chamber within the engine, through a heat exchanger, and back into the coolant chamber;

the coolant being pumped at a flow rate so that substantially no coolant vapor is formed outside of the coolant chamber;

the coolant also beingpumped at a flow rate and distributed through the coolant chamber so that substantially all of the liquid coolant in the coolant chamber that does not flow into contact with the metal surfaces of the engine is maintained below its saturation temperature, and substantially all of the coolant vapor formed within the coolant chamber is condensed by the liquid coolant;

exhausting gases or vapor not condensed by the liquid coolant in the coolant chamber therefrom, through means for exhausting coupled in fluid communication with a section of the apparatus at about ambient pressure or below that pressure and adapted to restrict the return of moisture to the coolant in the coolant chamber.

25. A process as defined in claim 24, wherein the coolant is pumped in the direction of the head portion of the engine toward the cylinder bore portion of the engine.

26. A process as defined in claim 24, wherein the coolant is pumped in the direction of the cylinder bore portion of the engine toward the head portion of the engine.

27. A process as defined in claim 24, wherein the coolant is pumped at a flow rate so that nucleate boiling and coolant vapor formation is maintained below a predetermined level.

28. A process as defined in claim 27, wherein the coolant flow rate for maintaining nucleate boiling and coolant vapor formation below a predetermined level is achieved by increasing the flow area of the heat exchanger and/or directing coolant to bypass the heat exchanger.

29. A process as defined in claim 24, further comprising the following step:

exhausting from a location in the engine at about ambient pressure or below that pressure, substantially all of the gases or vapors not condensed within the coolant chamber.

30. A process as defined in claim 29, further comprising the following step:

exhausting the gases or vapors not condensed within the coolant chamber through a reservoir of liquid coolant coupled in fluid communication with the coolant chamber, the reservoir of liquid coolant thus substantially preventing additional gases or vapor from entering the coolant chamber.

31. A process as defined in claim 24, wherein the coolant chamber is maintained at about atmospheric pressure.

32. A condenserless apparatus for cooling an internal combustion engine with a substantially anhydrous, boilable liquid coolant having a saturation temperature higher than that of water, comprising:

a coolant chamber formed adjacent to the combustion chamber domes and exhaust runners of the engine, the coolant chamber receiving the liquid coolant to cool the metal surfaces of the engine;

a heat exchanger coupled in fluid communication with the coolant chamber, the heat exchanger reducing the temperature of coolant flowing therethrough;

a coolant pump coupled in fluid communication with the coolant chamber and the heat exchanger to pump coolant therethrough, the coolant being pumped and distributed through the coolant chamber so that substantially no coolant vapor is formed due to a coolant pressure drop across the pump, and the temperature of the coolant adjacent to the combustion chamber domes and exhaust runners, but not in contact therewith, is maintained below the saturation temperature of the coolant, and substantially all coolant vaporized within the coolant chamber is condensed within the liquid coolant; and the means for exhausting gases or vapors not condensed by the liquid coolant within the coolant chamber therefrom, from a location in the engine at about ambient pressure or below that pressure.

33. An apparatus as defined in claim 32, wherein the means for exhausting includes an expansion tank to receive gases, vapors, and expanded liquid coolant from the coolant chamber.

34. An apparatus as defined in claim 33, wherein the means for exhausting further includes a vent line coupled in fluid communication with the expansion tank, the vent line including a portion located at or above the highest level of liquid coolant in the apparatus, the vent line thus permitting gases, vapor and expanded liquid coolant from the coolant chamber to flow therethrough.

35. An apparatus as defined in 34, wherein the expansion tank includes a first port coupled in fluid communication with the vent line, the first port being located below the coolant level in the expansion tank; and a second port coupled in fluid communication with the ambient atmosphere, the second port being located above the coolant level in the expansion tank, thus permitting gases or vapor in the expansion tank to flow therethrough, the coolant in the expansion tank in turn providing a liquid barrier between the first port and the second port.

36. An apparatus as defined in claim 32, wherein the liquid coolant is circulated in the direction of the head portion of the engine toward the cylinder bore portion of the engine.

37. An apparatus as defined in claim 32, wherein the liquid coolant is circulated in the direction of the cylinder bore portion of the engine toward the head portion of the engine.

38. A condenserless apparatus for cooling an internal combustion engine with a substantially anhydrous, boilable liquid coolant having a saturation temperature higher than that of water, comprising:

a coolant chamber surrounding the cylinder walls and combustion chambers of the engine, the coolant chamber receiving the coolant for cooling the metal surfaces of the engine, the coolant chamber including a coolant inlet to permit the coolant to flow therein, and a coolant outlet to permit the coolant to flow therefrom, the coolant outlet being located on the same side of the engine as the coolant inlet;

a coolant pump cooled in fluid communication with the coolant chamber, the coolant pump being adapted to pump the coolant through the coolant chamber at a flow rate so that the liquid coolant substantially condenses coolant vaporized upon contact with the metal surfaces of the engine;

a head gasket seated between a cylinder head and engine block of the engine, the head gasket defining a plurality of coolant apertures extending therethrough, the coolant apertures being in fluid communication with the coolant chamber to permit coolant to flow therethrough, each respective cooling aperture being located and sized so that coolant vaporized upon contact means for exhausting gases or vapor not condensed by the liquid coolant in the coolant chamber therefrom, the means for exhausting being coupled in fluid communication with a section of the apparatus at about ambient pressure or below that pressure and adapted to restrict the return of moisture to the coolant in the coolant chamber.

39. An apparatus as defined in claim 38, wherein the coolant apertures are located in a section of the head gasket contiguous to the side of the engine opposite the side of the coolant inlet and outlet.

40. An engine as defined in claim 39, wherein the coolant inlet and coolant outlet are located within the front half of the engine and the coolant apertures of the head gasket are located in about the rear half of the engine.

41. An condenserless apparatus for cooling an internal combustion engine with a substantially anhydrous liquid coolant, comprising:

a coolant chamber formed therein, the coolant chamber receiving the substantially anhydrous liquid coolant to cool the metal surfaces of the engine;

first means for exhausting gases and/or vapor from the coolant chamber in fluid communication therewith; and second means for removing water and/or water vapor flowing into the first means and coupled in fluid communication therewith.

42. An apparatus as defined in claim 41, wherein the second means includes a desiccant material to substantially remove the water and/or water vapor flowing therethrough.

43. An apparatus as defined in claim 42, wherein the first means includes an expansion tank coupled in fluid communication with the coolant chamber and the ambient atmosphere, the expansion tank receiving liquid coolant therein, the liquid coolant in the expansion tank thus providing a liquid barrier between the coolant chamber and the ambient atmosphere.

44. An apparatus as defined in claim 43, wherein the expansion tank defines a gas passage located above the level of coolant therein, the gas passage being in fluid communication with the second means, so that the gas entering the expansion tank through the gas passage is substantially demoisturized by the second means.

45. An apparatus as defined in claim 44, wherein the second means includes a cannister defining a desiccant chamber therein, the desiccant material being received within the desiccant chamber, the desiccant chamber being coupled in fluid communication with the gas passage and the ambient atmosphere, the gases entering the expansion tank through the gas passage thus being substantially demoisturized by flowing through the desiccant chamber.

46. An condenserless apparatus for cooling an internal combustion engine with a substantially anhydrous, boilable liquid coolant having a saturation temperature higher than that of water, comprising:

a coolant chamber formed therein to receive the liquid coolant to cool the surfaces of the engine;

means for exhausting gases or vapor not condensed by the liquid coolant in the coolant chamber therefrom, the means for exhausting being coupled in fluid communication with a section of the apparatus at about ambient pressure or below that pressure;

means for distributing coolant through the coolant chamber so that coolant vaporized upon contact with the metal surfaces of the engine substantially condenses in the liquid coolant; and a pump coupled in fluid communication with the coolant chamber and the heat exchanger to pump the coolant therethrough at a flow rate so that coolant vaporized upon contact with the metal surfaces of the engine substantially condenses in the liquid coolant.

47. An apparatus as defined in claim 46, wherein:

the means for exhausting includes a coolant tank coupled in fluid communication with the coolant chamber and the ambient atmosphere, the coolant tank being provided to receive gases, vapor and/or expanded coolant from the coolant chamber, the coolant tank holding liquid coolant therein to provide a liquid coolant barrier between the coolant chamber and the ambient atmosphere.

48. An apparatus as defined in claim 46, wherein:

the means for distributing includes a head gasket seated between a cylinder head and engine block of the engine, the head gasket defining several apertures therethrough, the apertures being in fluid communication with the coolant chamber to permit coolant to flow therethrough, each respective aperture being located and sized so that coolant vaporized upon contact with the metal surfaces of the engine substantially condenses in the liquid coolant.

49. An apparatus for cooling an internal combustion engine with a substantially anhydrous, boilable liquid coolant having a saturation temperature higher than that of water, comprising:

a coolant chamber surrounding the cylinder walls and combustion chambers of the engine to receive the coolant for cooling the metal surfaces of the engine;

a coolant pump coupled in fluid communication with the coolant chamber, the coolant pump being adapted to pump the coolant through the coolant chamber at a flow rate so that the liquid coolant substantially condenses coolant vaporized upon contact with the metal surfaces of the engine;

means for distributing coolant through the coolant chamber so that coolant vaporized upon contact with the metal surfaces of the engine substantially condenses in the liquid coolant;

a head gasket seated between a cylinder head and an engine bock of the engine;

the means for distributing includes a plurality of coolant apertures extending through the head gasket, each of the coolant apertures being in fluid communication with the coolant chamber to permit coolant to flow therethrough;

a first coolant inlet in fluid communication with the coolant chamber, the radiator and the pump;

A coolant outlet in fluid communication with the coolant chamber and the pump, the coolant outlet being located at about the midpoint of the coolant chamber measured between a front wall and a rear wall of the engine; and a second coolant inlet in fluid communication with the coolant chamber, and the radiator and/or the coolant pump, the second coolant inlet being located on the opposite side of the engine of the first coolant inlet.

50. An apparatus for cooling an internal combustion engine with a substantially anhydrous, boilable liquid coolant having a saturation temperature higher than that of water, comprising:

a coolant chamber surrounding the cylinder walls and combustion chambers of the engine to receive the coolant for cooling the metal surfaces of the engine;

a coolant pump coupled in fluid communication with the coolant chamber, the coolant pump being adapted to pump the coolant through the coolant chamber at a flow rate so that the liquid coolant substantially condenses coolant vaporized upon contact with the metal surfaces of the engine;

means for distributing coolant through the coolant chamber so that coolant vaporized upon contact with the metal surfaces of the engine substantially condenses in the liquid coolant;

means for exhausting gases or vapor not condensed by the liquid coolant in the coolant chamber therefrom, the means for exhausting being coupled in fluid communication with a section of the apparatus at about ambient pressure or below that pressure;

an expansion tank coupled in fluid communication with the coolant chamber, to receive expanded liquid coolant and/or gases or vapors from the coolant chamber;

the expansion tank is in fluid communication with the ambient atmosphere and receives liquid coolant therein to maintain a substantially liquid coolant barrier between the coolant chamber and the ambient atmosphere;

an expansion tank defines an inlet port and an outlet port, the inlet port extending through a bottom wall thereof and being in fluid communication with the coolant chamber, the outlet port extending through a top wall thereof and being in fluid communication with the ambient atmosphere, the inlet port being located below the coolant level in the expansion tank and the outlet port being located above the coolant level in the expansion tank, the liquid coolant in the expansion tank thus providing a liquid seal between the outlet port and the coolant chamber; and a dehydrating unit coupled in fluid communication with the outlet port of the expansion tank, the dehydrating unit substantially removing the water vapor flowing therethrough and into the outlet port.

51. An apparatus as defined in claim 50, wherein the dehydrating unit includes a desiccant material to substantially remove the water vapor.

52. An apparatus for cooling an internal combustion engine with a substantially anhydrous liquid coolant, comprising:

a coolant chamber formed therein, the coolant chamber receiving the substantially anhydrous liquid coolant to cool the metal surfaces of the engine;

first means for exhausting gases and/or vapor from the coolant chamber in fluid communication therewith;

second means for removing water and/or water vapor flowing into the first means and coupled in fluid communication therewith;

the second means includes a desiccant material to substantially remove the water and/or water vapor flowing therethrough.

53. An apparatus as defined in claim 52, wherein the first means includes an expansion tank coupled in fluid communication with the coolant chamber and the ambient atmosphere, the expansion tank receiving liquid coolant therein, the liquid coolant in the expansion tank thus providing a liquid barrier between the coolant chamber and the ambient atmosphere.

54. An apparatus as defined in claim 53, wherein the expansion tank defines a gas passage located above the level of coolant therein, the gas passage being in fluid communication with the second means, so that the gas entering the expansion tank through the gas passage is substantially demoisturized by the second means.

55. An apparatus as defined in claim 54, wherein the second means includes a cannister defining a desiccant chamber therein, the desiccant material being received within the desiccant chamber, the desiccant chamber being coupled in fluid communication with the gas passage and the ambient atmosphere, the gases entering the expansion tank through the gas passage thus being substantially demoisturized by flowing through the desiccant chamber.

* * * * *